US007696932B2

(12) United States Patent
Desclos et al.

(10) Patent No.: US 7,696,932 B2
(45) Date of Patent: Apr. 13, 2010

(54) ANTENNA CONFIGURED FOR LOW FREQUENCY APPLICATIONS

(75) Inventors: Laurent Desclos, San Diego, CA (US); Sebastian Rowson, San Diego, CA (US); Rowland Jones, Carlsbad, CA (US); Ki Soo Kim, Gunpo-si (KR)

(73) Assignee: Ethertronics, San Diego, CA (US)

( * ) Notice: Subject to any disclaimer, the term of this patent is extended or adjusted under 35 U.S.C. 154(b) by 353 days.

(21) Appl. No.: 11/675,557

(22) Filed: Feb. 15, 2007

(65) Prior Publication Data

US 2007/0229376 A1 Oct. 4, 2007

Related U.S. Application Data

(63) Continuation-in-part of application No. 11/396,442, filed on Apr. 3, 2006.

(51) Int. Cl.
*H01Q 1/24* (2006.01)

(52) U.S. Cl. ..... 343/702

(58) Field of Classification Search ..... 343/702, 343/718, 895, 700 MS
See application file for complete search history.

(56) References Cited

U.S. PATENT DOCUMENTS 5,136,303 A * 8/1992 Cho et al. ..... 343/718

(Continued)

FOREIGN PATENT DOCUMENTS

EP 0443491 A 8/1991
JP 57 206102 12/1982
WO WO 2004/047222 6/2004
WO WO 2006/121241 11/2006
WO WO 2007/117527 10/2007

OTHER PUBLICATIONS

Hara et al., "Broad band monolithic microwave active inductor and its application to miniaturize wide band amplifiers." IEEE Trans. Microwave Theory Tech., 36:1920-1924,1988.

(Continued)

*Primary Examiner*—Huedung Mancuso
(74) *Attorney, Agent, or Firm*—Joshua S. Schoonover; Coastal Patent Agency

(57) ABSTRACT

An antenna configured for low frequency applications on a mobile device includes an antenna element coupled to a conductive structure which, in turn, is coupled to the user of the mobile device such that the user of the mobile device effectively becomes part of the antenna. The conductive structure can include, for example, the device housing being made from a conductive material, a conductive structure embedded inside the device housing, or conductive pads exposed in the device housing. The antenna element is electrically connected to the conductive structure and the user can be coupled to the conductive structure either through direct contact or through capacitive coupling. In addition, the antenna can include an active element configured to boost free space operation efficiency. The active element can include, for example, a low noise amplifier integrated onto a low noise amplifier board. The active element can be at least partially surrounded by a hollow support structure around which an antenna coil is wrapped, where the antenna coil is coupled to the active element. Furthermore, one or more antenna coils can be utilized either separately or in conjunction with the antenna for low frequency applications, where the one or more antenna coils can have integrated therein inductive components and/or active/switching elements that allow the one or more antenna coils to be tuned to a desired frequency.

42 Claims, 38 Drawing Sheets

U.S. PATENT DOCUMENTS

| | | | | |
|---|---|---|---|---|
| 5,338,900 | A | 8/1994 | Schneider et al. | |
| 5,898,413 | A * | 4/1999 | Mandai et al. | 343/895 |
| 6,047,163 | A | 4/2000 | Mitoshi | |
| 6,456,243 | B1 | 9/2002 | Poilasne et al. | |
| 6,822,611 | B1 | 11/2004 | Kontogeorgakis et al. | |
| 7,038,634 | B2 * | 5/2006 | Bisig | 343/866 |
| 7,162,217 | B2 * | 1/2007 | Bisig | 455/269 |
| 7,315,286 | B2 * | 1/2008 | Lee et al. | 343/702 |
| 2002/0030630 | A1 | 3/2002 | Maeda | |
| 2004/0204023 | A1 | 10/2004 | Desclos et al. | |

OTHER PUBLICATIONS

International Search report for PCT Patent Application No. PCT/US2008/054016.

International Search Report of PCT/US2007/008440.

* cited by examiner

Figure 34A
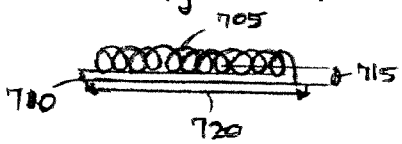
Figure 34B
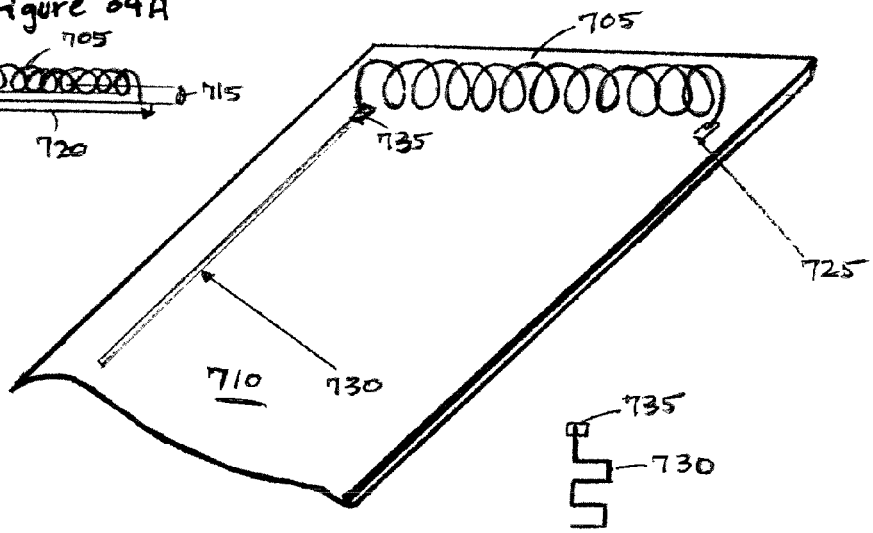
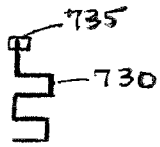
Figure 34C
Figure 35A
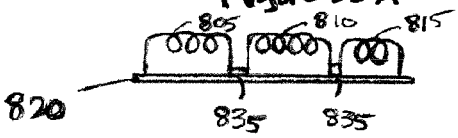
Figure 35B
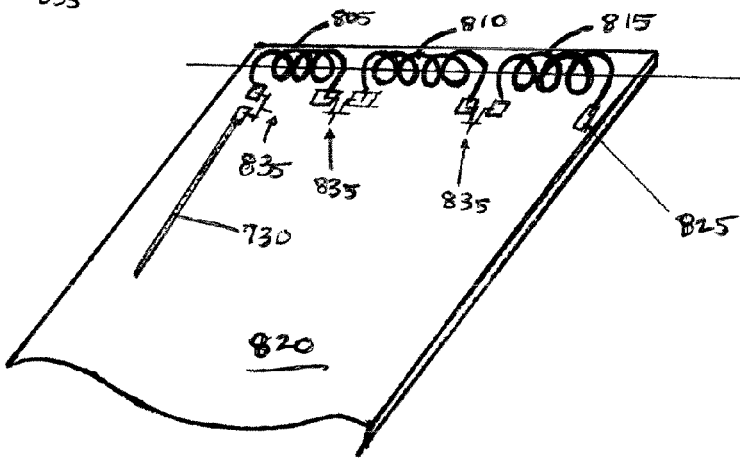

ANTENNA CONFIGURED FOR LOW FREQUENCY APPLICATIONS

CROSS-REFERENCE TO RELATED PATENT APPLICATIONS

This application is a Continuation-In-Part of U.S. application Ser. No. 11/396,442, filed Apr. 3, 2006, incorporated herein by reference in its entirety.

FIELD OF THE INVENTION

The present invention relates generally to the field of wireless communications and devices, and more particularly to the design of antennas configured for low frequency applications.

BACKGROUND

As new generations of handsets and other wireless communication devices become smaller and embedded with more and more applications, new antenna designs will be needed to provide solutions to inherent limitations of these devices. With classical antenna structures, a certain physical volume is required to produce a resonant antenna structure at a particular radio frequency and with a particular bandwidth. In multiband applications, more than one such resonant antenna structure may be required. With the advent of a new generation of wireless devices, such classical antenna structure will need to take into account beam switching, beam steering, space or polarization antenna diversity, impedance matching, frequency switching, mode switching, etc., in order to reduce the size of devices and improve their performance.

In addition, wireless devices are experiencing a convergence with other mobile electronic devices. Due to increases in data transfer rates and processor and memory resources, it has become possible to offer a myriad of products and services on wireless devices that have typically been reserved for more traditional electronic devices. For example, modern day mobile communications devices can be equipped to receive broadcast television signals. These signals tend to be broadcast at very low frequencies, 200-700 Mhz, compared to more traditional cellular communication frequencies of, for example, 800/900 Mhz and 1800/1900 Mhz. One problem with existing mobile device antenna designs is that they are not easily excited at such low frequencies. The present invention addresses the need for antenna designs equipped to be excited at relatively low frequencies in order to support low frequency applications.

SUMMARY OF THE INVENTION

The present invention includes one or more embodiments of devices including an antenna equipped to support low frequency applications. In one embodiment, the device includes a conductive structure in an area that is intended to be in contact with the user of the device when the user is holding the device. The antenna is coupled to the conductive structure such that the conductive structure and user become part of the antenna element when the device is being used. The antenna element can be coupled to the conductive structure by a direct electrical connection. In one embodiment, a conductor connects the conductive structure of the device to the antenna element. The conductor can be configured in any of a number of forms, such as a conductive wire, conductive pads, etc. The user can be directly or indirectly coupled to the antenna through the conductive structure. For example, the user can directly contact the conductive structure or can be capacitively coupled to the conductive structure.

In addition, the antenna can also be coupled to an active element, where the active element serves to boost efficiency of free space operation of the antenna in addition to the conductive structure or instead of the conductive structure. The active element can comprise a low noise amplifier integrated onto a low noise amplifier board. The active element can also comprise a ground pin and a power supply pin for driving the active element. Furthermore, the active element can be at least partially surrounded by a hollow support structure or protrude from the hollow support structure. A helical antenna coil wrapped around the hollow support structure is electrically coupled to the active element.

Various antenna designs and configurations can be used in embodiments of the invention. For example, the antenna element can include a plurality of portions, the plurality of portions coupled to define a capacitively loaded dipole antenna. The antenna can also include at least one active control element, wherein the at least one control element is electrically coupled to one or more of the portions. One or more of the plurality of portions may define a capacitive area, wherein at least one control element is disposed generally in the capacitive area. One or more of the plurality of portions may define an inductive area, wherein at least one control element is disposed generally in the inductive area. One or more of the plurality of portions may define a feed area, wherein at least one control element is disposed generally in the feed area.

The plurality of portions may comprise a top portion, a middle portion, and a bottom portion, wherein the top portion is coupled to the bottom portion, the bottom portion is coupled to the middle portion, and the middle portion is disposed generally between the top portion and the bottom portion. The top portion and the middle portion may define a capacitive area, and the middle portion and bottom portion may define an inductive area. One or more control elements may be disposed in the capacitive area, and/or the inductive area. The control elements may be coupled to the top portion and to the middle portion the middle portion and the bottom portion, and/or the top portion to the bottom portion. The control elements may comprise a switch, may exhibit active capacitive or inductive characteristics, may comprise a transistor device, such as a FET device, or may comprise a MEMs device. The device may further comprise a wireless communications device, a feed point, and a ground point, wherein the wireless communications device is coupled to the antenna through the feed point and the ground point.

In one embodiment, an antenna comprises a ground plane, a first conductor having a first length extending generally longitudinally above the ground plane and having a first end electrically connected to the ground plane at a first location, a second conductor having a second length extending generally longitudinally above the ground plane, the second conductor having a first end electrically connected to the ground plane at a second location, an antenna feed coupled to the first conductor, and a first active component, the first active component comprising a control input, wherein an input to the control input enables characteristics of the antenna to be configured. The first and second conductors may overlap to form a gap, wherein the first active component is disposed in the gap. The first conductor or the second conductor may comprise the first active component. The first active component may be disposed between the second conductor and the ground plane, between the first conductor and the ground plane or between the feed and the ground plane. The antenna may further comprise a first stub coupled to the feed. The first stub may comprise the first active component. The first active component may also be disposed between the first stub and the ground plane. The antenna may further comprise a second stub and a second active component, wherein the first stub comprises the first active component, and wherein the second active component is coupled between the second stub and the ground plane.

In another embodiment, the antenna may comprise a ground plane, having a first side and a second side, a first capacitively loaded dipole antenna, and a second capacitively loaded dipole antenna, wherein the first antenna is coupled to the first side of the ground plane, and wherein the second antenna is coupled to the second side of the ground plane. The antenna may further comprise a first active component, the first active component comprising a first control input, wherein an input to the first control input enables characteristics of the first antenna to be configured, and a second active component, the second active component comprising a second control input, wherein an input to the second control input enables characteristics of the second antenna to be configured.

In one embodiment, a capacitively loaded dipole antenna may comprise control means for actively controlling characteristics of the antenna. One embodiment of a method for actively controlling characteristics of a capacitively loaded dipole antenna may comprise providing a capacitively loaded dipole antenna, providing a control element, the control element coupled to the antenna, providing an input to the control element, and controlling the characteristics of the antenna with the input.

In another embodiment, the antenna comprises one or more antenna characteristic, a ground portion, a conductor coupled to the ground portion, the conductor disposed in an opposing relationship to the ground portion, and a control portion coupled to the antenna to enable active reconfiguration of the one or more antenna characteristic. The conductor may comprise a plurality of conductor portions, and the control portion may be coupled between two of the conductor portions. The conductor may comprise a plurality of conductor portions, wherein one or more gap is defined by the conductor portions, and wherein the control portion is disposed in a gap defined by two of the conductor portions. The control portion may be disposed in a gap defined by the ground portion and the conductor, and the control portion may be coupled to the ground portion and the conductor. The antenna may further comprise a stub, wherein the stub comprises one or more stub portion, and wherein at least one stub portion is coupled to the conductor portion. A first end of a control portion may be coupled to one stub portion and a second end of a control portion maybe coupled to a second stub portion, ground portion or the conductor. The conductor may comprise a plurality of conductor portions, and a control portion may be coupled between two of the conductor portions. The ground portion and the plurality of conductor portions may be coupled to define a capacitively coupled magnetic dipole antenna. The stub may be disposed on the ground portion, or between the ground portion and the conductor. The antenna may comprise a multiple band antenna.

In yet another embodiment, the antenna element comprises at least one antenna coil operatively connected to a printed circuit board (PCB), where the length and pitch of the at least one antenna coil allows the operating frequency and efficiency of the antenna element to be adjusted. The antenna element can also be comprised of a plurality of antenna coils operatively connected to each other via inductive components or active elements thereby adding inductive and/or effective electrical length. The inductive components and the active elements can act as filters and ON/OFF switches, respectively, to allow tuning of the antenna element to desired frequencies, in particular, those utilized in low frequency applications. The plurality of antenna coils can also be operatively connected to each other in various orthogonal configurations which are suitable for polarization diversity and the control of frequency bands. Additionally, one or more antenna coils can be utilized in conjunction with an existing antenna element, such as a magnetic dipole antenna.

Other embodiments are also within the scope of the invention and should be limited only by the claims that follow.

BRIEF DESCRIPTION OF THE DRAWINGS

FIGS. 34A-34C illustrate a further embodiment of the invention incorporating a trace element for operating in conjunction with the antenna coil of FIGS. 32A and 32B.

FIGS. 35A and 35B illustrate an embodiment of the invention incorporating the multiple antenna coils of FIGS. 33A and 33B, the trace element of FIGS. 34A and 34B and active elements.

DETAILED DESCRIPTION OF THE INVENTION

Figure 1A:
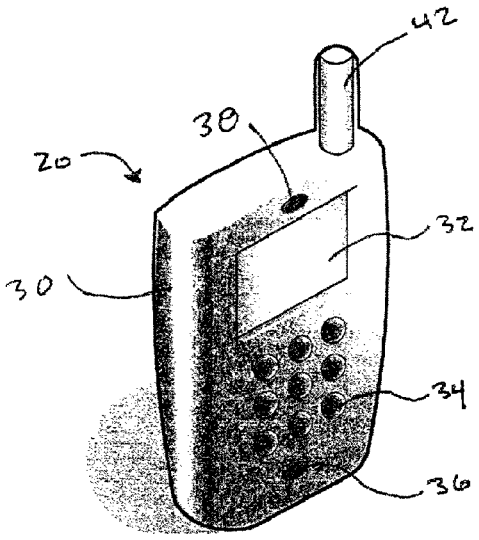
FIGS. 1A-D illustrate embodiments of a mobile device according to the present invention.
Figure 1B:
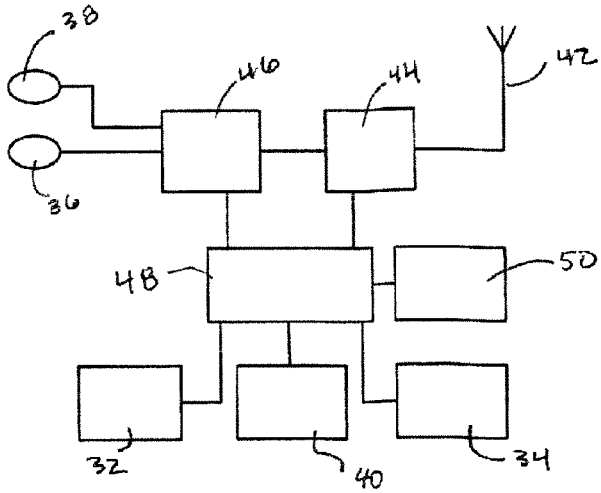

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

In the embodiments of the invention shown in FIGS. 1A-D, a mobile device (20), such as a mobile telephone, includes a conductive structure (30), a display (32) in the form of a liquid crystal display, a keypad (34), a microphone (36), an speaker (38), a battery (40), an antenna (42), radio interface circuitry (44), codec circuitry (46), a controller (48) and a memory (50). In the embodiment shown in FIGS. 1A and 2C, the conductive structure (30) comprises the device housing, which, in this example, comprises a conductive material, such as stainless steel. In this embodiment, a user of the mobile device (20) effectively becomes coupled to the antenna (42) by holding onto the conductive structure (30) comprising the housing in a manner such that the user becomes part of the antenna (42) when the device (20) is in use.

Figure 2A:
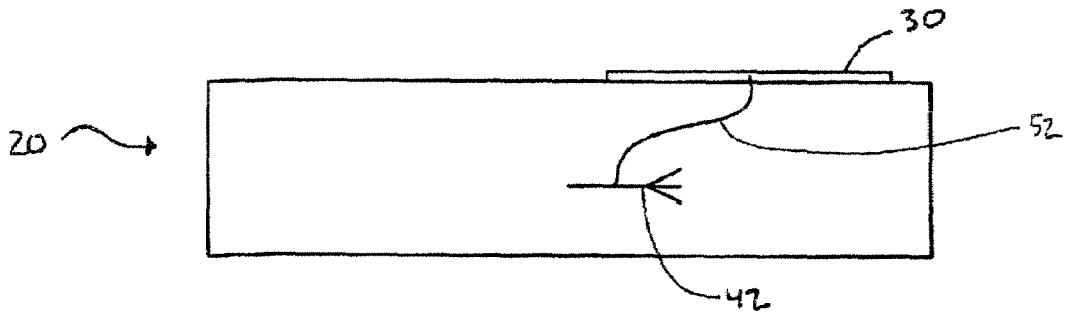
FIGS. 2A, 2B, and 2C illustrate various couplings between the antenna and conductive structure of the device of FIGS. 1A-D.
Figure 2B:
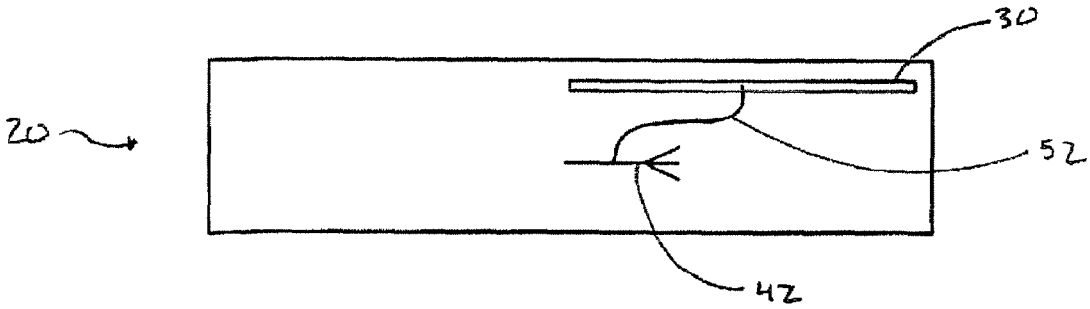

In another embodiment shown in FIG. 2B, the conductive structure (30) can be inside the housing. For example, the housing can comprise a plastic shell and a conductive structure, such as a metal plate, can be embedded inside the housing. Alternatively, the conductive structure (30) can be secured on the inside surface of the housing or in another area inside the housing. In this embodiment, the user becomes effectively coupled to the antenna (42) through capacitive coupling with the conductive structure (30) by holding onto the mobile device (20) in an area near the conductive structure (30). In this manner, the user becomes part of the antenna (42) similar to the way a user became part of so-called "rabbit ears" television antennas of days past.

Figure 1C:
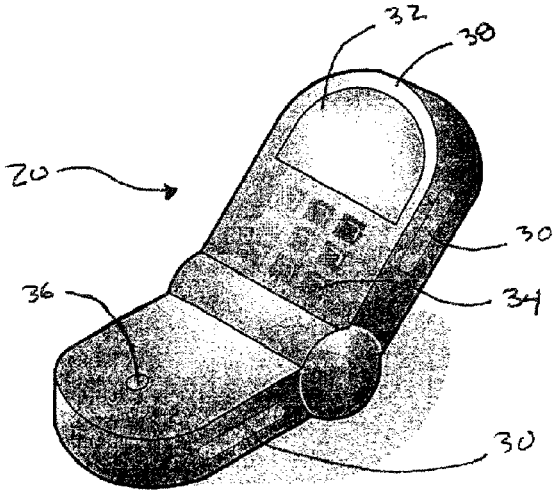
Figure 1D:
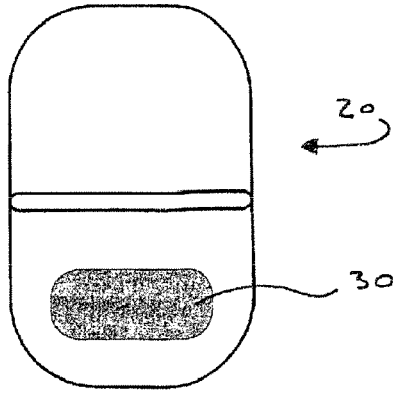

In still another embodiment, the conductive structure (30) can comprise conductive pads on the external surface of the device housing. As shown in FIGS. 1C, 1D, and 2A, the conductive pads can be positioned in a variety of locations on the surface of the device (20). FIG. 1C shows a perspective view of a mobile device (20) wherein the conductive pads are positioned in each side of the device (20) in an area usually contacted by the user's fingers when holding the device (20). FIG. 1D shows a rear view of the mobile device (20) of FIG. 1C. As shown in FIG. 1D, a conductive pad can also be placed on the rear surface of the device (20) in an area usually contacted by the palm of a user's hand when holding the device (20). In this embodiment, the user becomes effectively coupled to the antenna (42) by direct contact with the conductive structure (30) (i.e. conductive pads) in a manner such that the user becomes part of the antenna (42) when the device (20) is in use. In one embodiment, the conductive pads can comprise stickers or decals including conductive material such as metal contact pads. In another embodiment, the conductive pads can comprise exposed metal plates embedded in the device housing.

Figure 2C:
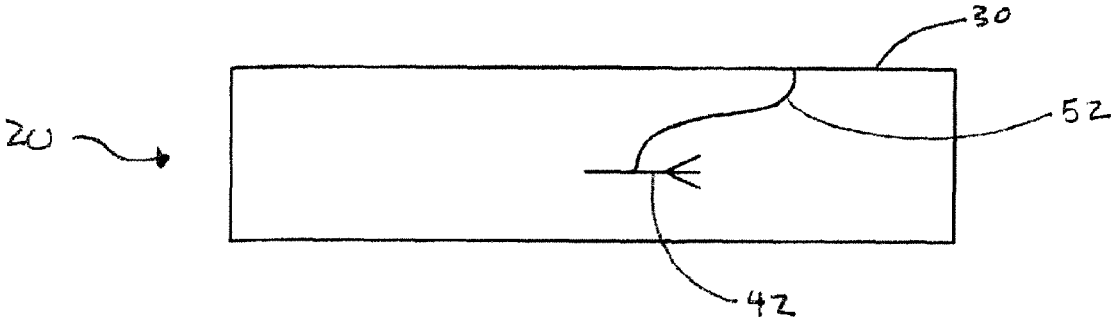

The antenna 42 can be coupled to the conductive structure (30) in any number of ways. For example, as shown in FIG. 2A-C, a conductor (52), in the form of a wire, can electrically connect the antenna (42) to the conductive structure (30).

Different embodiments of antennas may be used which may be actively changed or configured, with resultant small or large changes in characteristics of the antenna being achieved. One characteristic that is configurable is resonant frequency. In one embodiment, a frequency shift in the resonant frequency of the antenna can be actively induced, for example, to follow a spread spectrum hopping frequency (Bluetooth, Home-RF, etc.,). In addition to providing enhanced low frequency performance embodiments of the present invention also provide very small and highly isolated antennas that covers a few channels at a time, with the ability to track hopping frequencies quickly, improving the overall system performance.

In one embodiment, an antenna is provided with frequency switching capability that may be linked to a particular user, device, or system defined operating mode. Mode changes are facilitated by active real time configuration and optimization of an antenna's characteristics, for example as when switching from a 800 MHz AMPS/CDMA band to a 1900 MHz CDMA band or from a 800/1900 MHz U.S. band to a 900/1800 MHz GSM Europe and Asia band.

In one embodiment, the present invention comprises a configurable antenna that provides a frequency switching solution that is able to cover multiple frequency bands, either independently or at the same time A software-defined antenna for use in a software defined device is also disclosed. The device may comprise a wireless communications device, which may be fixed or mobile. Examples of other wireless communications devices within the scope of the present invention include cell phones, PDAs, and other like handheld devices.

Communication devices and antennas operating in one or more of frequency bands used for wireless communication devices (450 MHz, 800 MHz, 900 MHz, 1.575 GHz, 1.8 GHz, 1.9 GHz, 2 GHz, 2.5 GHz, 5 GHz,) are also considered to be within the scope of the invention. Other frequency bands are also considered to be within the scope of the present invention. Embodiments of the present invention provide the ability to optimize antenna transmission characteristics in a network, including radiated power and channel characteristics.

In one or more embodiments, channel optimization may be achieved by providing a beam switching, beam steering, space diversity, and/or multiple input-multiple output antenna design. Channel optimization may be achieved by either a single element antenna with configurable radiation pattern directions or by an antenna comprising multiple elements. The independence between different received paths is an important characteristic to be considered in antenna design. The present invention provides reduced coupling between multiple antennas, reducing correlation between channels.

The antenna design embodiments of the present invention may also be used when considering radiated power optimization. In one embodiment, an antenna is provided that may direct the antenna near-field toward or away from disturbances and absorbers in real time by optimizing antenna matching and near-field radiation characteristics. This is particularly important in handset and other handheld device designs, which may interact with human bodies (hands, heads, hips, . . . ). In one embodiment, wherein one antenna is used in a communications device, input impedance may be actively optimized (control of the reflected signal, for example). In one embodiment where a device comprises multiple antennas, each antenna may be optimized actively and in real time.

Figure 3:
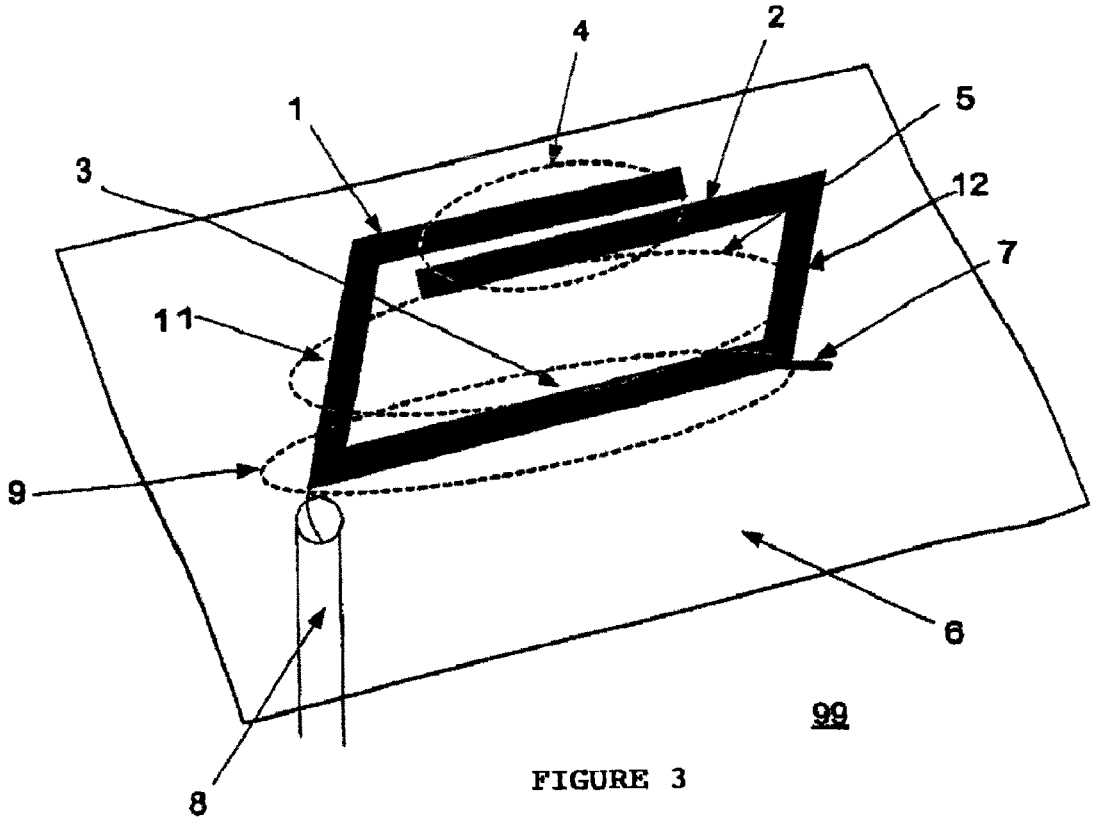
FIG. 3 illustrates a three-dimensional view of one embodiment of a capacitively loaded magnetic dipole.
Figure 4:
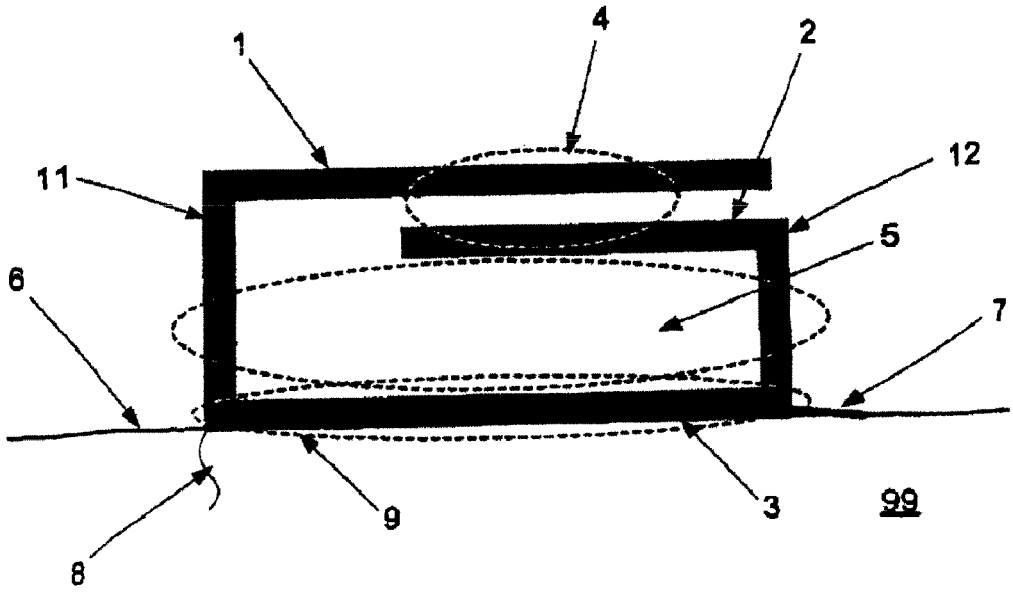
FIG. 4 illustrates a side-view of one embodiment of a capacitively loaded magnetic dipole.

FIGS. 3 and 4 illustrate a respective three-dimensional view and a side view of an embodiment of a capacitively loaded magnetic dipole antenna (99). In one embodiment, the antenna (99) comprises a top (1), a middle (2), and a bottom (3) portion. The top (1) portion is coupled to bottom portion (3), and the bottom portion (3) is coupled to the middle portion (2). In one embodiment, the top portion (1) is coupled to the bottom portion (3) by a portion (11), and the bottom portion (3) is coupled to middle portion (2) by a portion (12). In one embodiment, the portion (11) and the portion (12) are generally vertical portions and generally parallel to each other, and the portions (1), (2), and (3) are generally horizontal portions and generally parallel to each other. It is understood, however, that the present invention is not limited to the illustrated embodiment, as in other embodiments the portions (1), (2), (3), (11), and/or (12) may comprise other geometries. For example, top portion (1) may be coupled to bottom portion (3) and bottom portion (3) may be coupled to middle portion (2) such that one or more of the portions are generally in nonparallel and non-horizontal relationships. In embodiments that utilize a portion (11) and a portion (12), nonparallel and/or non-vertical geometries of portion (11) and (12) are also within the scope of the present invention. In one embodiment, portions (1), (2), (3), (11), and (12) may comprise conductors. In another embodiment, the portions (1), (2), (3), (11), and (12) may comprise conductive plate structures, wherein the plate structures of each portion are coupled and disposed along one or more plane. For example, in the embodiment of FIG. 3 and FIG. 4, plate portions are disposed and coupled along a plane that is vertical to a grounding plane (6). In another embodiment, plate portions may also be disposed and coupled along planes that are at right angles and/or parallel to the grounding plane (6). Thus, it is understood that the portions of antenna (99), as well as the portions of other antennas described herein, may comprise other geometries and other geometric structures and yet remain within the scope of the present invention.

In one embodiment, the bottom portion (3) is attached to a grounding plane (6) at a grounding point (7), and bottom portion (3) is powered through a feedline (8). The antenna (99) of FIGS. 3 and 4 may be modeled as an LC circuit, with a capacitance (C) that corresponds to a fringing capacitance that exists across the gap defined generally by top portion (1) and middle portion (2), indicated generally as area (4), and with an inductance (L) that corresponds to an inductance that exists in an area indicated generally as area (5) and that is generally bounded by the middle portion (2) and the bottom portion (3). As will be understood with reference to the foregoing Description and Figures, the geometrical relationships of one or more portions in the capacitive area (4) may be utilized to effectuate large changes in the resonant frequency of the antenna (99), and the geometrical relationships between one or more portions in the inductive area (5) may be used to effectuate medium frequency changes. As well, geometrical relationships between one or more portions in a feed area (9) may be utilized to effectuate small frequency changes. The areas (4), (5), and (9) may also be utilized for input impedance optimization.

Figure 5A:
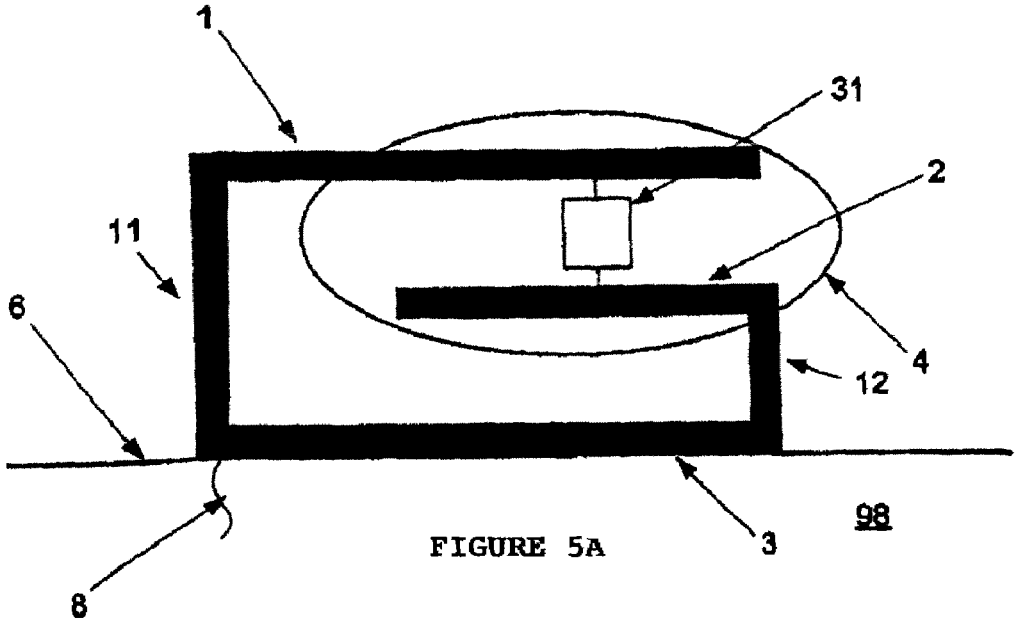
FIGS. 5A, 5B 6A, 6B, 6C, 7A and 7B illustrate side-views of embodiments of a capacitively loaded magnetic dipole including a control element.
Figure 5B:
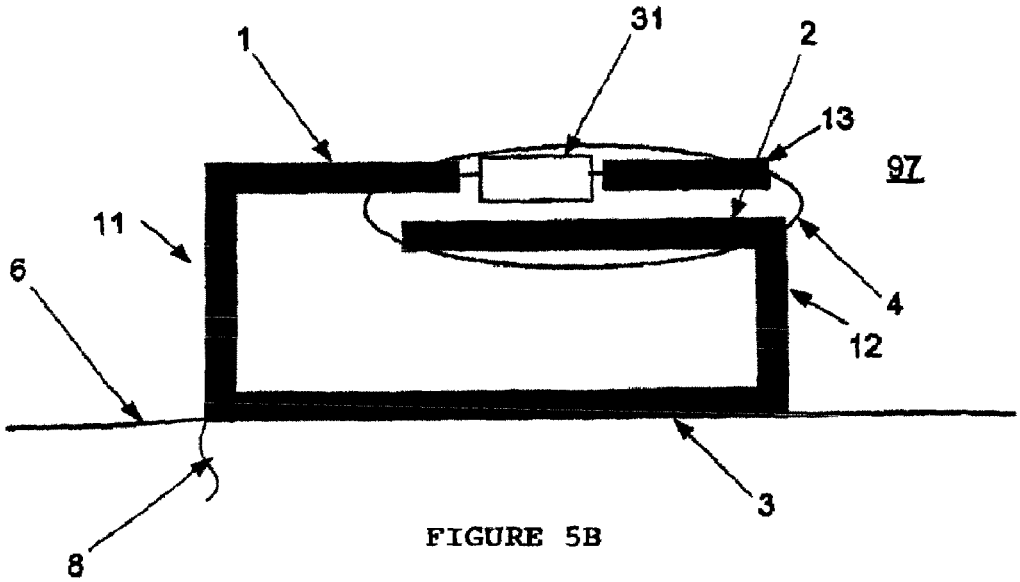

FIG. 5A illustrates a side-view of one embodiment of a capacitively loaded magnetic dipole antenna (98), wherein a control element (31) is disposed generally in area (4). In the illustrated embodiment, control element (31) is electrically coupled at one end to top portion (1) and at another end to middle portion (2). In one embodiment, control element (31) comprises a device that may exhibit ON-OFF and/or actively controllable capacitive/inductive characteristics. In one embodiment, control element (31) may comprise a transistor device, a FET device, a MEMs device, or other suitable control element or circuit capable of exhibiting ON-OFF and/or actively controllable capacitive/inductive characteristics. It is identified that control element (31), as well as other control elements described further herein, may be implemented by those of ordinary skill in the art and, thus, control element (31) is described herein only in the detail necessary to enable one of such skill to implement the present invention. In one embodiment wherein the control element (31) comprises a switch with ON characteristics, the capacitance in area (4) is short-circuited, and antenna (98) may be switched off, no energy is radiated. In one embodiment, wherein the capacitance of the control element (31) may be actively changed, for example, by a control input to a connection of a FET device or circuit connected between top portion (1) and middle portion (2), the control element (31) will be understood by those skilled in the art as capable of acting generally in parallel with the fringing capacitance of area (4). It has been identified that the resulting capacitance of the control element (31) and the fringing capacitance may be varied to change the LC characteristics of antenna (98) or, equivalently, to vary the resonant frequency of the antenna (98) over a wide range of frequencies FIG. 5B illustrates a side view of one embodiment of a capacitively loaded magnetic dipole antenna (97), wherein a control element (31) is disposed generally in area (4). In the illustrated embodiment, control element (31) is electrically coupled at one end to top portion (1) and at another end to a tip portion (13). In one embodiment, control element (31) comprises a device that may exhibit ON-OFF and/or actively controllable capacitive/inductive characteristics. In one embodiment, control element (31) may comprise a transistor device, an FET device, a MEMs device, or other suitable control element. In one embodiment, wherein the control element (31) electrically couples or decouples the tip portion (13) from the top portion (1), for example as by the ON characteristics of a switch, the length of top portion (1) of antenna (97) may be increased or decreased such that the capacitance in area (4) may be changed to actively change the resonant frequency of antenna (97) from one resonant frequency to another resonant frequency. In one embodiment, wherein the capacitance of the control element (31) may be actively changed, for example, by a control input of an FET device or circuit, the control element (31) will be understood by those skilled in the art as capable of acting generally in series with the fringing capacitance of area (4). It has been identified that the resulting capacitance may be varied to actively change the LC characteristics of antenna (97) or, equivalently, to vary the resonant frequency of the antenna (98) over a wide range of frequencies.

Figure 6A:
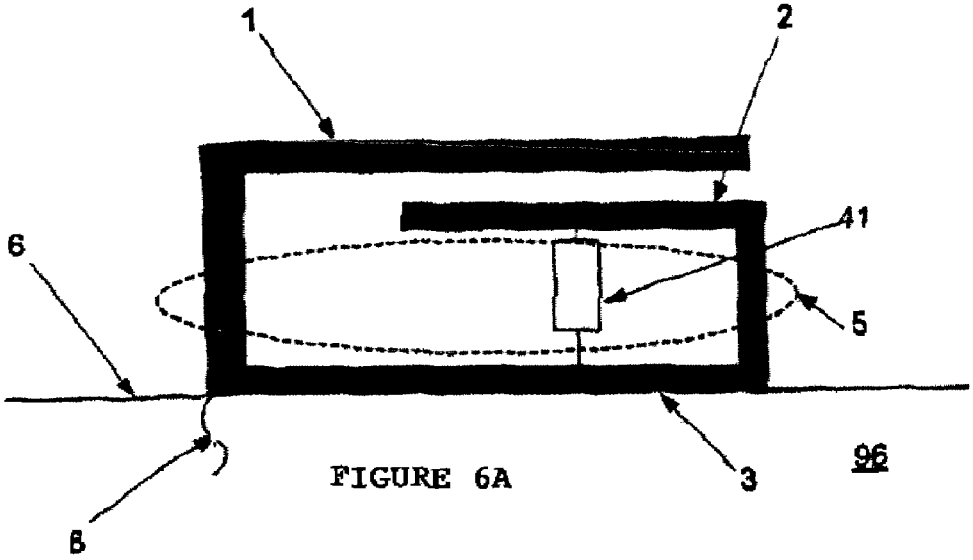

FIG. 6A illustrates a side-view of a capacitively loaded magnetic dipole antenna (96), wherein a control element (41) is disposed generally in area (5). In the illustrated embodiment, control element (41) is electrically coupled at one end to bottom portion (3) and at another end to middle portion (2). In one embodiment, control element (41) comprises a device that may exhibit ON-OFF and/or actively controllable capacitive or inductive characteristics. In one embodiment, control element (41) may comprise a transistor device, an FET device, a MEMs device, or other suitable control element or circuit. In one embodiment wherein the control element (41) exhibits ON characteristics, the inductance in area (5) is short-circuited and antenna (96) may be switched off. In one embodiment, the inductance of the control element (41) may be actively changed, for example, by a control input to a device or circuit connected between the bottom portion (3) and the middle portion (2). An example of a device or circuit that enables active control of inductance is presented in "Broad band monolithic microwave active inductor and its application to miniaturize wide band amplifiers" presented in IEEE Trans. Microwave Theory Tech, vol. 36, pp. 1020-1924, December 1988 by S. Hara, T. Tokumitsu, T. Tanaka, and M. Aikawa, which is incorporated herein by reference. Control element (41) will be understood by those skilled in the art as capable of acting as an inductor generally in parallel with the inductance of area (5). It has been identified that the resulting inductance may be varied to change the LC characteristics of antenna (96) or, equivalently, to vary the resonant frequency of the antenna (96) over a medium range of frequencies.

Figure 6B:
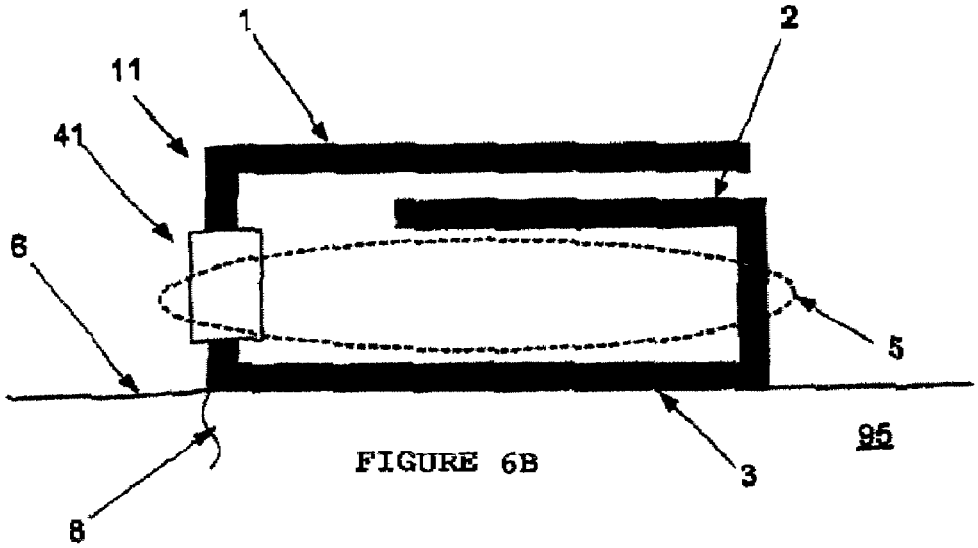

FIG. 6B illustrates a side-view of one embodiment of a capacitively loaded magnetic dipole antenna (95), wherein a control element (41) is disposed generally in area (5) at a break in portion (11) and electrically coupled at one end to top portion (1) and at another end to bottom portion (3). In one embodiment, control element (41) comprises a device that may exhibit ON-OFF and/or actively controllable capacitive or inductive characteristics. In one embodiment, control element (41) may comprise a transistor device, a FET device, a MEMs device, or other suitable control element or circuit. In one embodiment, where the control element (41) exhibits OFF characteristics, it has been identified that the LC characteristics of the antenna (95) may be changed such that antenna (95) operates at a frequency 10 times higher then the frequency at which the antenna operates with a control element that exhibits ON characteristics. In one embodiment, wherein the inductance of the control element (41) may be actively controlled, it has been identified that the resonant frequency of the antenna (95) may be varied quickly over a narrow bandwidth.

Figure 6C:
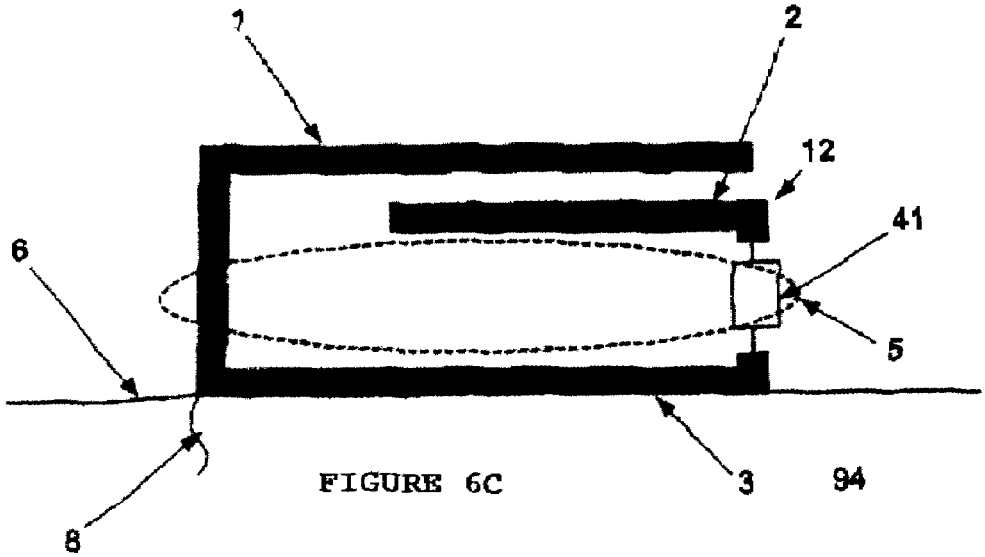

FIG. 6C illustrates a side-view of one embodiment of a capacitively loaded magnetic dipole antenna (94), wherein a control element (41) is disposed generally in area (5) and electrically coupled at a break in portion (12) at one end to a middle portion (2) and at another end to bottom portion (3). In one embodiment, control element (41) comprises a device that may exhibit ON-OFF and/or actively controllable capacitive or inductive characteristics. In one embodiment, control element (41) may comprise a transistor device, an FET device, a MEMs device, or other suitable control element or circuit. In one embodiment, wherein the control element (41) exhibits OFF characteristics, it has been identified that the LC characteristics of the antenna (94) may be changed such that antenna (94) operates at a frequency 10 times higher then the frequency at which the antenna operates with a control element that exhibits ON characteristics. In one embodiment, wherein the inductance of the control element (41) may be actively controlled, it has been identified that the resonant frequency of the antenna (94) may be changed quickly over a narrow bandwidth.

Figure 7A:
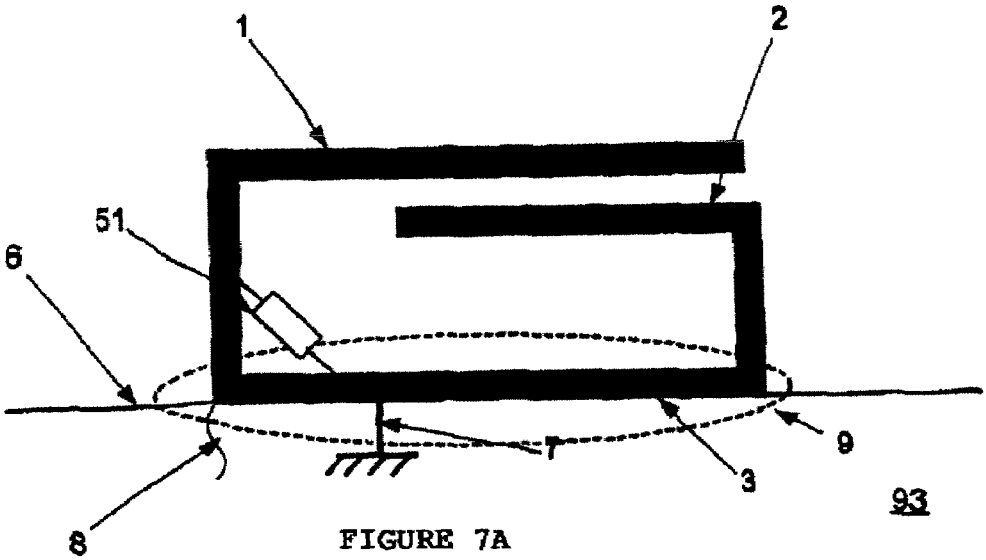

FIG. 7A illustrates a side-view of an embodiment of a capacitively loaded magnetic dipole antenna (93), wherein a control dement (51) is disposed generally in area (9) and coupled at one end generally at feed point (8) and at another end along the bottom portion (3) along grounding plane (6). In one embodiment, control element (51) comprises a device that may exhibit ON-OFF and/or actively controllable capacitive or inductive characteristics. In one embodiment, control element (51) may comprise a transistor' device, an FET device, a MEMs device, or other suitable control element or circuit. In one embodiment, wherein the control element (51) exhibits ON characteristics, the antenna (93) is short-circuited and no power is either radiated or received by the antenna (93). With a control element exhibiting OFF characteristics, the antenna (93) may operate normally. In one embodiment, wherein the inductance and/or capacitance of the control element (51) may be controlled, it has been identified that it is possible to control the input impedance of the antenna such that the input impedance may be adjusted in order to maintain the test antenna characteristics while the antenna's environment is changing.

Figure 7B:
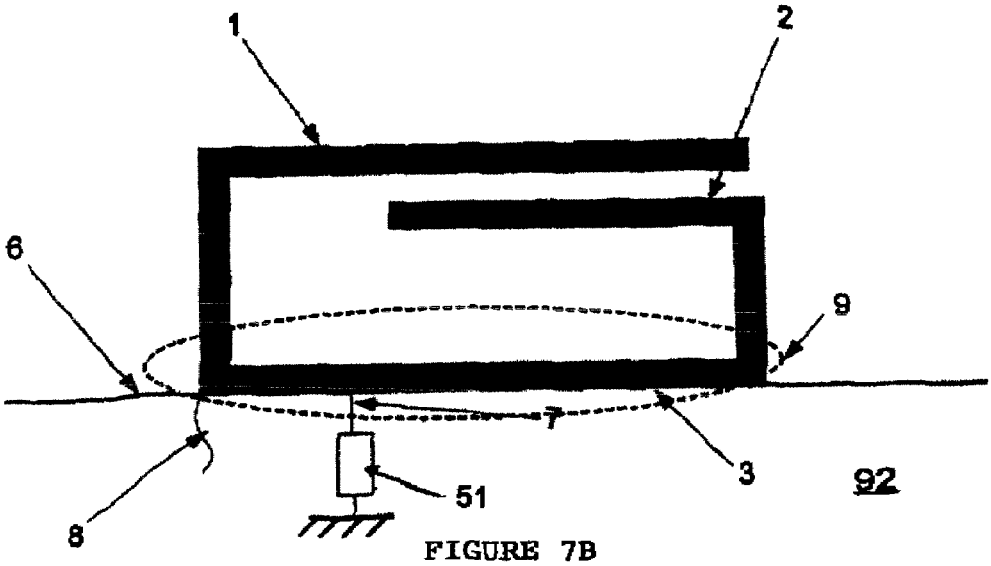

FIG. 7B illustrates a side-view of an other embodiment of capacitively loaded magnetic dipole antenna (92), wherein a control element (51) is disposed generally in feed area (9) and coupled at one end to bottom portion (3) and coupled at another end at a ground point. In one embodiment, wherein the control element exhibits ON characteristics, the antenna (92) operates normally, whereas with OFF characteristics exhibited by the control element, the antenna acts as an open circuit. It is possible to control the input impedance of the antenna controlling the inductance and capacitance of the control element (51). In one embodiment, the input impedance may thus be adjusted while the antenna environment is changing in order to maintain the best antenna characteristics.

Figure 8A:
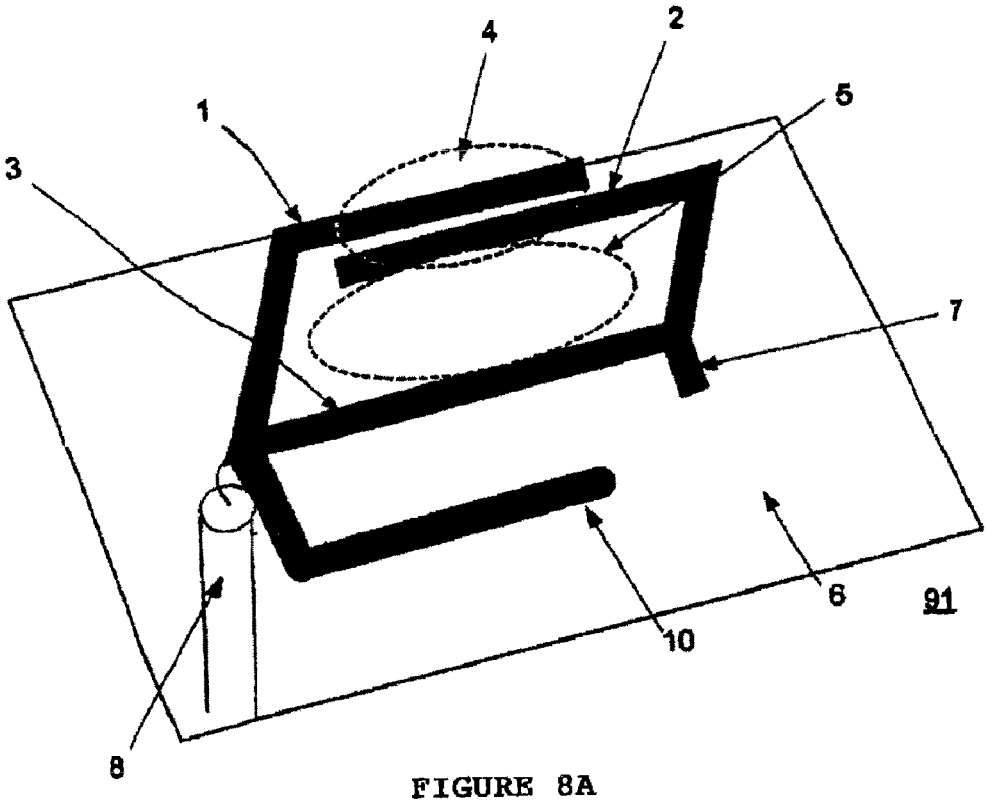
FIGS. 8A and 8B illustrates three-dimensional views of embodiments of a capacitively loaded magnetic dipole, comprising a capacitive area, and an inductive area on which a stub has been added along a feed area.

FIG. 8A illustrates a three-dimensional view of one embodiment of a capacitively loaded magnetic dipole antenna (91) comprising a capacitive (4) and an inductive (5) area, and further including a first stub (10) electrically coupled to a feedline (8). The first stub (10) may be used to increase the bandwidth of the capacitively loaded magnetic dipole antenna (91) and/or to create a second resonance to increase the overall usable bandwidth of the antenna (91).

Figure 8B:
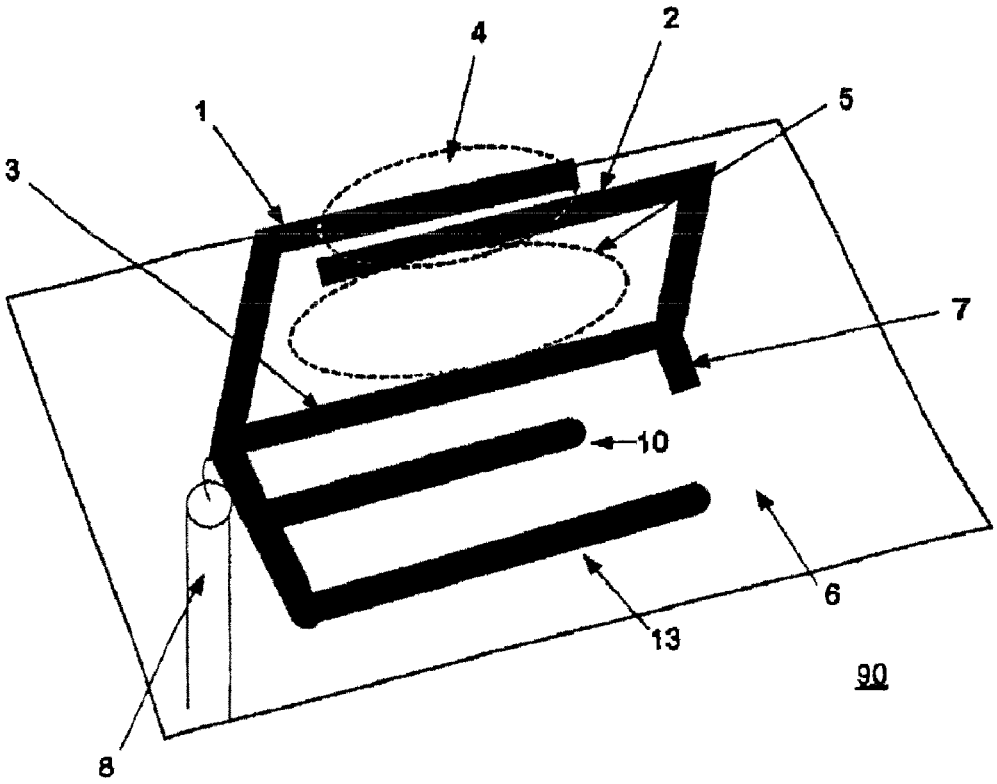

FIG. 8B illustrates a three-dimensional view of another embodiment of a capacitively loaded magnetic dipole antenna (90) comprising a capacitive (4) and an inductive (5) area, and further including a first stub (10) coupled to a feedline (8), and a second stub (13) electrically coupled to the feedline (8).

Figure 9A:
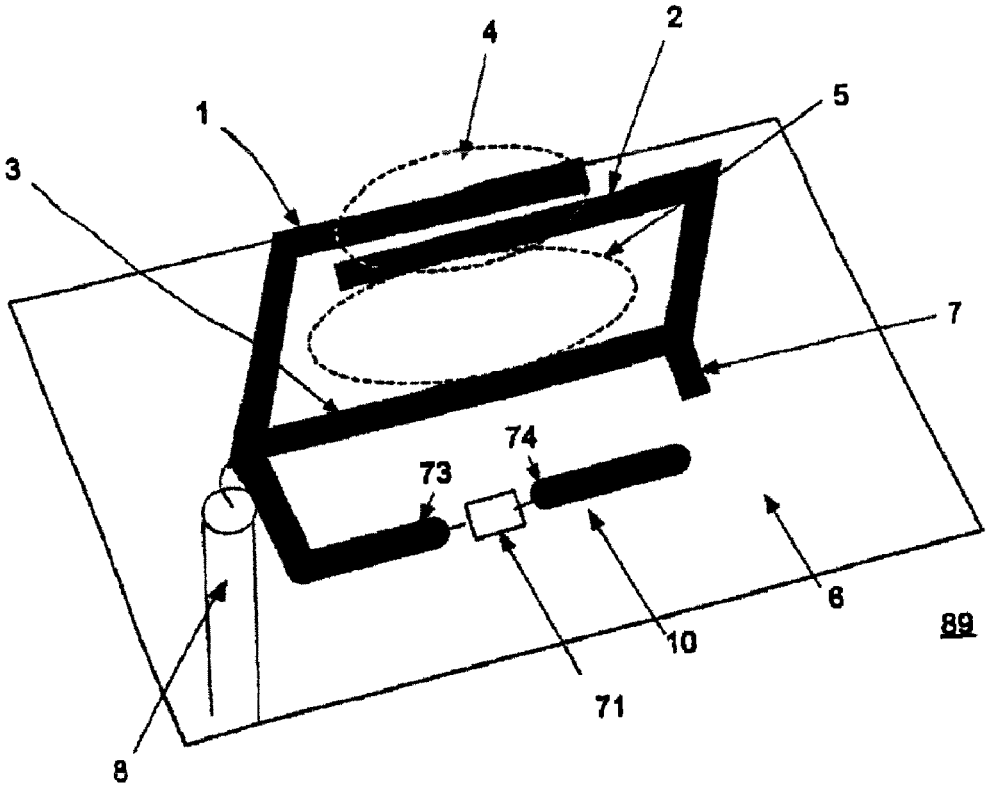
FIG. 9A illustrates a three-dimensional view of one embodiment of a capacitively loaded magnetic dipole, comprising a capacitive area, an inductive area, and a stub along which is placed a control element.

FIG. 9A illustrates a three-dimensional view of an embodiment of a capacitively loaded magnetic dipole antenna (89) comprising a capacitive area (4), an inductive (5) area, and a stub (10). In one embodiment, the electrical continuity of stub (10) is interrupted by electrical connection of a control element (71), which as indicated in FIG. 9A is disposed along a break in stub (10) between points (73) and (74). In one embodiment, control element (71) comprises a device that may exhibit ON-OFF and/or actively controllable capacitive or inductive characteristics. In one embodiment, control element (71) may comprise a transistor device, an FET device, a MEMs device, or other suitable control element or circuit. In one embodiment, with a control element (71) that exhibits ON characteristics, the entire length of stub (10) acts to influence the antenna (89) characteristics. With the control element (71) exhibiting OFF characteristics, only the part of the stub (10) making electrical contact with the antenna acts to affect the LC circuit of the antenna (89). In one embodiment, it has been identified that by controlling the inductance and capacitance of control element (71) it is possible to achieve a controllable variation of frequency or bandwidth, or to effectuate impedance matching of the antenna (89).

Figure 9B:
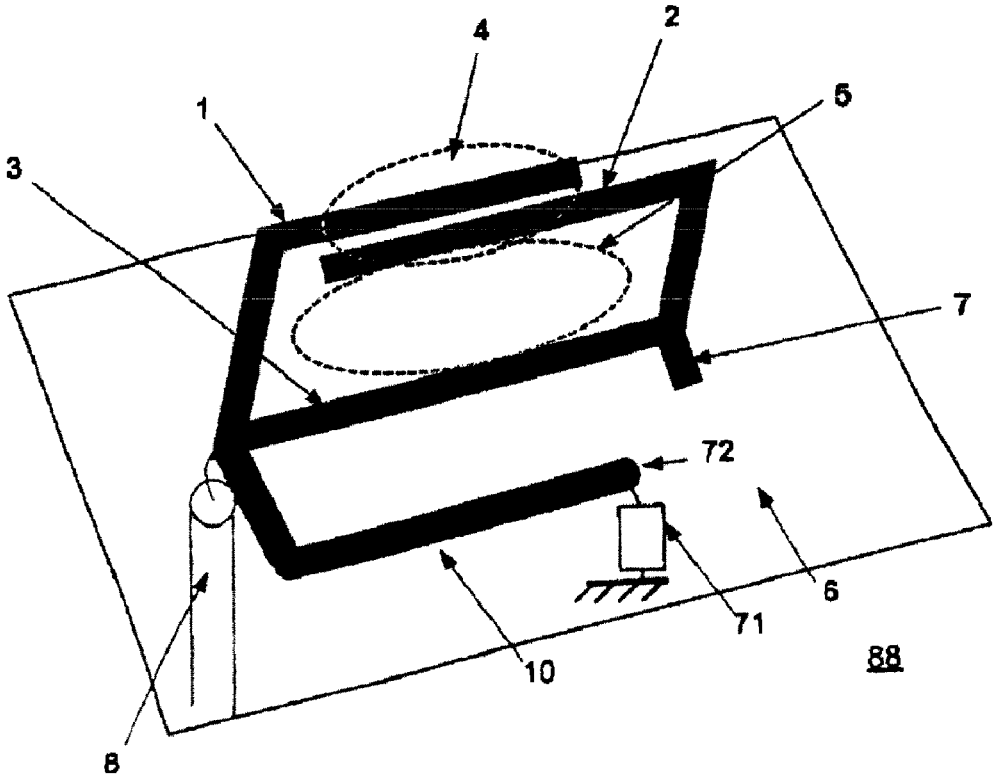
FIG. 9B illustrates a three-dimensional view of one embodiment of a capacitively loaded magnetic dipole, comprising a capacitive area, an inductive area, and a stub at the tip of which is placed a control element.

FIG. 9B illustrates a three-dimensional view of another embodiment of a capacitively loaded magnetic dipole antenna (88) comprising a capacitive (4) area, an inductive (5) area, and a stub (10). As illustrated in FIG. 9B, one end of a control element (71) is electrically coupled to stub (10) at its end portion (72) and another end of stub (10) is coupled to a ground point. In one embodiment, control element (71) comprises a device that may exhibit ON-OFF and/or actively controllable capacitive or inductive characteristics. In one embodiment, control element (71) may comprise a transistor device, an FET device, a MEMs device, or other suitable control element or circuit. In one embodiment, wherein control element (71) exhibits ON characteristics, stub (10) is short-circuited. With the control element (71) comprising OFF characteristics, the stub (10) may act to influence the operating characteristics of antenna (88). In one embodiment wherein inductance and capacitance of the control element (71) may be actively controlled, it has been identified that it is possible to have a continuous variation of resonance frequency or bandwidth.

Figure 9C:
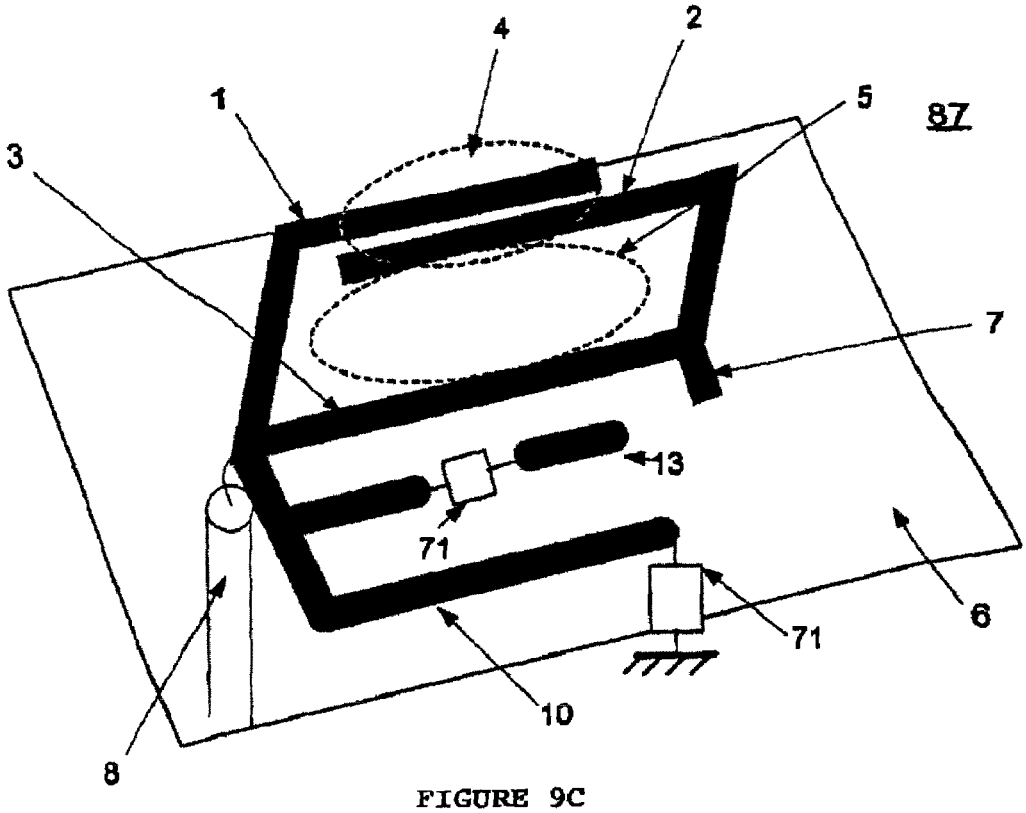
FIG. 9C illustrates a three-dimensional view of one embodiment of a capacitively loaded magnetic dipole, comprising a capacitive area, an inductive area, and multiple stubs with control elements placed on them.

FIG. 9C illustrates a three-dimensional view of still another embodiment of a capacitively loaded magnetic dipole antenna (87), comprising a capacitive (4) area, an inductive (5) area, a first stub (10), and a second stub (13). In one embodiment, stub (10) and stub (13) may incorporate respective control elements (71) as referenced in FIGS. 9A and 9B, to effectuate changes in the LC characteristics of antenna (87) in accordance with descriptions previously presented herein.

Figure 10:
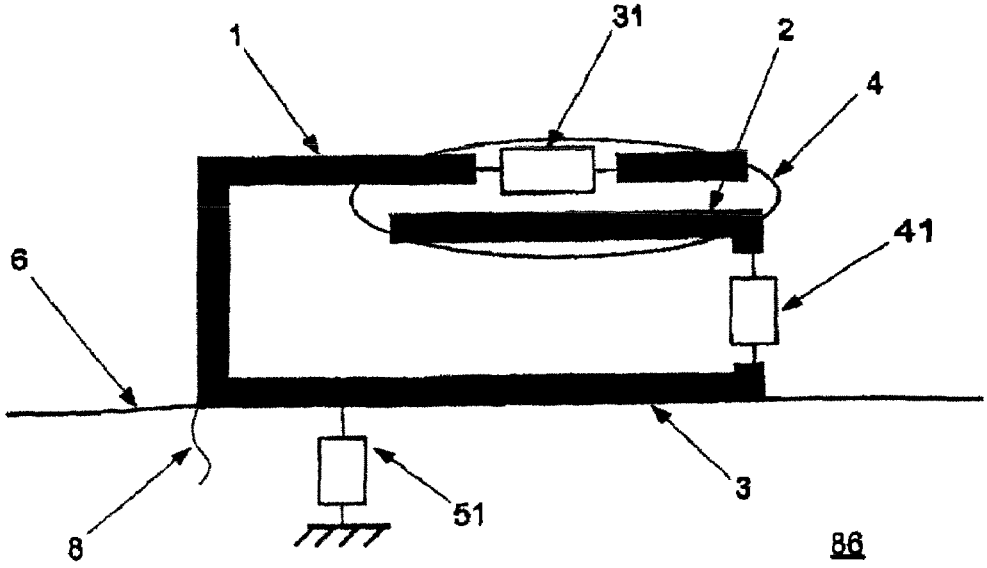
FIG. 10 illustrates a view of one embodiment of a capacitively loaded magnetic dipole, comprising a capacitive area, an inductive area, and a stub.

FIG. 10 illustrates a side view of an embodiment of a capacitively loaded magnetic dipole antenna (86) comprising a capacitive (4) area, an inductive area (not shown), and a stub (not visible in side view). In one embodiment, a control element (31) may be disposed in upper portion (1) to effectuate changes in the operating frequency of the antenna (86), for example, to effectuate changes from a 800/1900 MHz US frequency band to a 900/1900 MHz GSM Europe and Asia frequency band. In one embodiment, a second control element (41) may be disposed in portion (12) to effectuate changes in the resonant frequency of antenna (86) over a range of frequencies. In one embodiment, a control element (51) may be disposed between lower portion (3) and a ground point to effectuate control of the input impedance as a function of loading of the antenna (86). A control feedback signal for effectuating control may be obtained by monitoring the quality of transmissions emanating from the antenna (86). In one embodiment, a control element may be disposed in the stub to effectuate control of a second resonance corresponding to a transmitting band.

It is identified that one way to improve the transmission quality of an antenna is to switch an antenna's beam direction or to steer an antenna's beam. In one embodiment, beam switching may be obtained with two capacitively loaded magnetic dipoles that are switched ON or OFF using control elements as described herein.

Figure 11A:
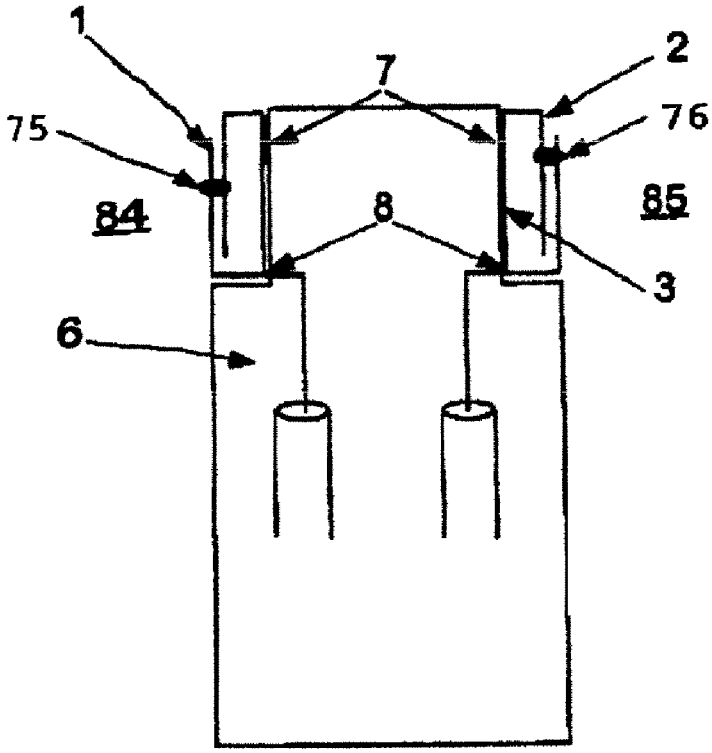
FIG. 11A illustrates a top view of one embodiment of two capacitively loaded magnetic dipoles flush and parallel on both sides of a ground plane with each of the radiating elements including a control element.

FIG. 11A illustrates a top view of one embodiment of two capacitively loaded magnetic dipole antennas (84, 85). In one embodiment, each antenna is opposingly disposed flush and parallel to a ground plane (6). In one embodiment, each antenna (84, 85) may comprise respective control elements (75, 76). By controlling each control element (75, 76) to exhibit ON-OFF characteristics, respective radiating elements comprising a top portion (1) of a respective antenna can be turned OFF or ON to effectuate utilization of one antenna or the other. With both control elements (75, 76) exhibiting OFF characteristics, both antennas (84, 85) may be utilized to provide a wider radiation pattern.

Figure 11B:
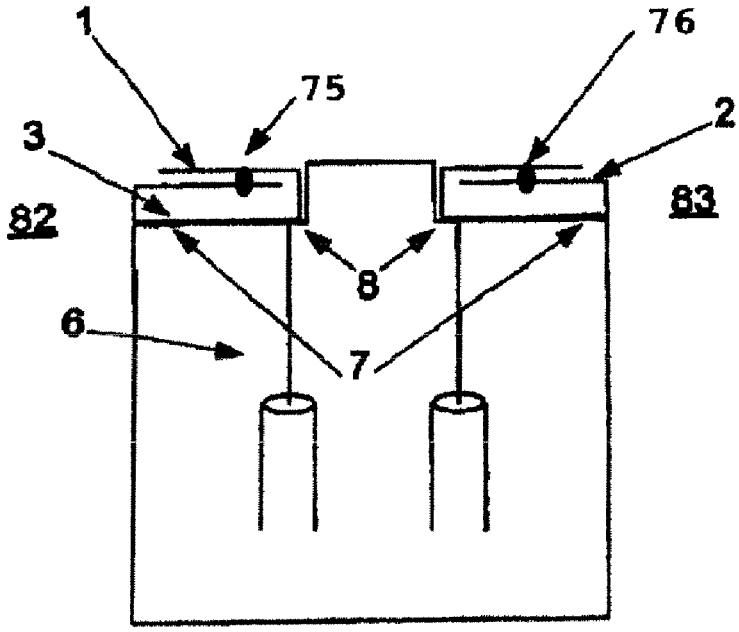
FIG. 11B illustrates a top view of one embodiment of two capacitively loaded magnetic dipoles flush back to back on both sides of a ground plane with each of the radiating elements including a control element.

FIG. 11B illustrates a top view of another embodiment of two capacitively loaded magnetic dipole antennas (82, 83). In one embodiment, each antenna is opposingly disposed flush and back to back on both sides of a ground plane (6). In one embodiment, each antenna comprises respective control elements (75, 76). By controlling each control element (75, 76) to exhibit ON-OFF characteristics, respective radiating elements comprising a top portion (1) of a respective antenna can be turned OFF or ON in order to utilize one antenna or the other. Alternatively, if both control elements (75, 76) exhibit OFF characteristics, both antennas (82, 83) can be utilized to offer wider antenna coverage.

Figure 12A:
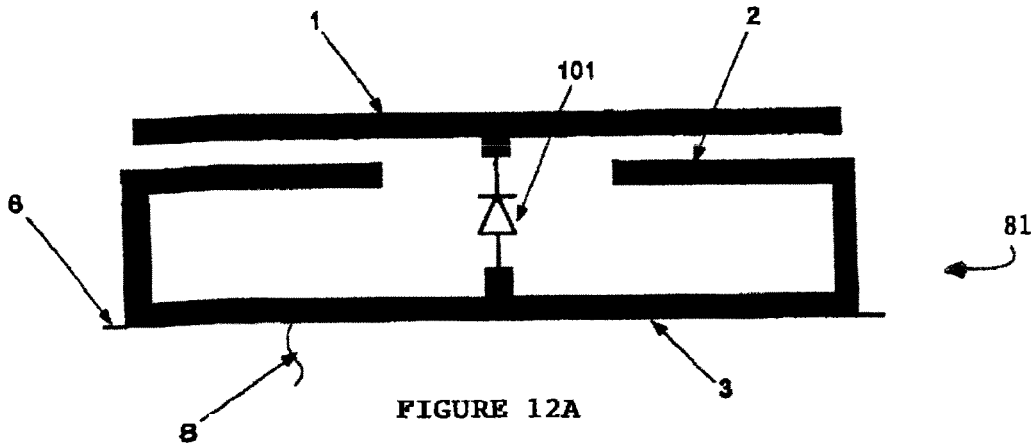
FIG. 12A illustrates one embodiment of two capacitively loaded magnetic dipoles back to back, sharing the connection from a top portion to a bottom portion wherein along the shared connection is a control element.

FIG. 12A illustrates one embodiment of two capacitively loaded magnetic dipoles coupled in a back-to-back configuration to comprise an antenna (81). In one embodiment, a top portion (1) of antenna (81) is coupled to a bottom portion (3) by a vertical portion that comprises a control element (101), which is electrically connected to top portion (1) at the end and to bottom portion (3) at another end. In one embodiment, wherein control element (101) exhibits ON characteristics, the antenna (81) LC characteristics are defined by parallel capacitance and inductance generally defined by capacitive and inductive areas (not shown). With a control element that exhibits OFF characteristics, it has been identified that antenna (81) resonates at a lower frequency and a wider area of coverage and bandwidth.

Figure 12B:
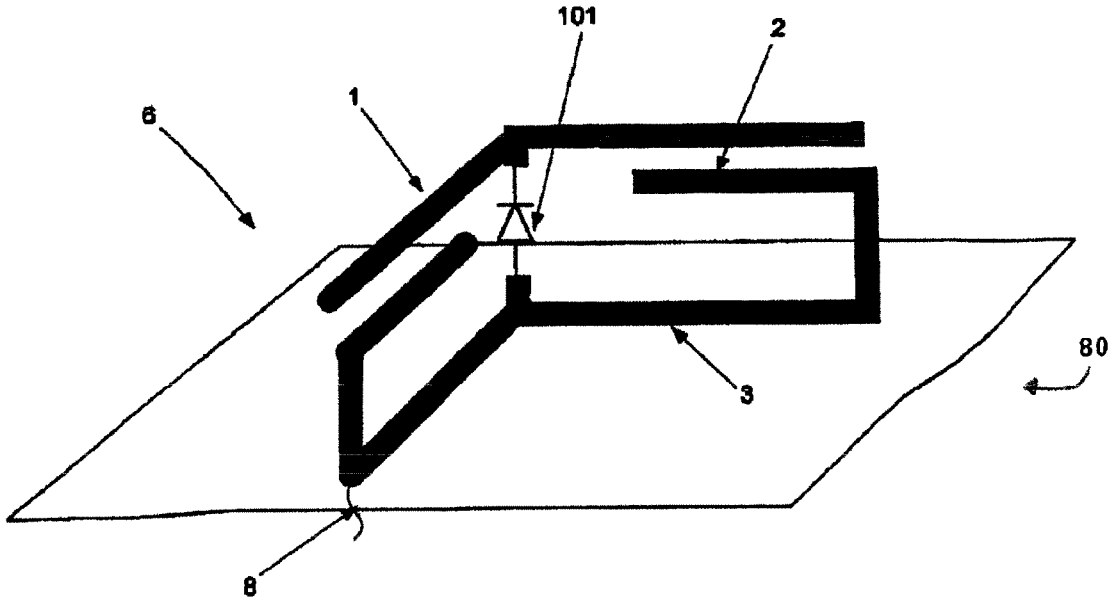
FIG. 12B illustrates one embodiment of two capacitively loaded magnetic dipoles sharing the connection from a top portion to a bottom portion.

FIG. 12B illustrates another configuration of two capacitively loaded magnetic dipoles coupled to comprise an antenna (80). In one embodiment, a top portion (1) of antenna (80) is coupled to a bottom portion (3) by a vertical portion that comprises a control element (101), which is electrically connected to top portion (1) at one end and to bottom portion (3) at another end. In the illustrated embodiment, top radiating portions (1) of antenna (80) are orthogonal rather than in the same plane, which provides polarization diversity in the radiation pattern provided by the radiating portions.

Figure 13:
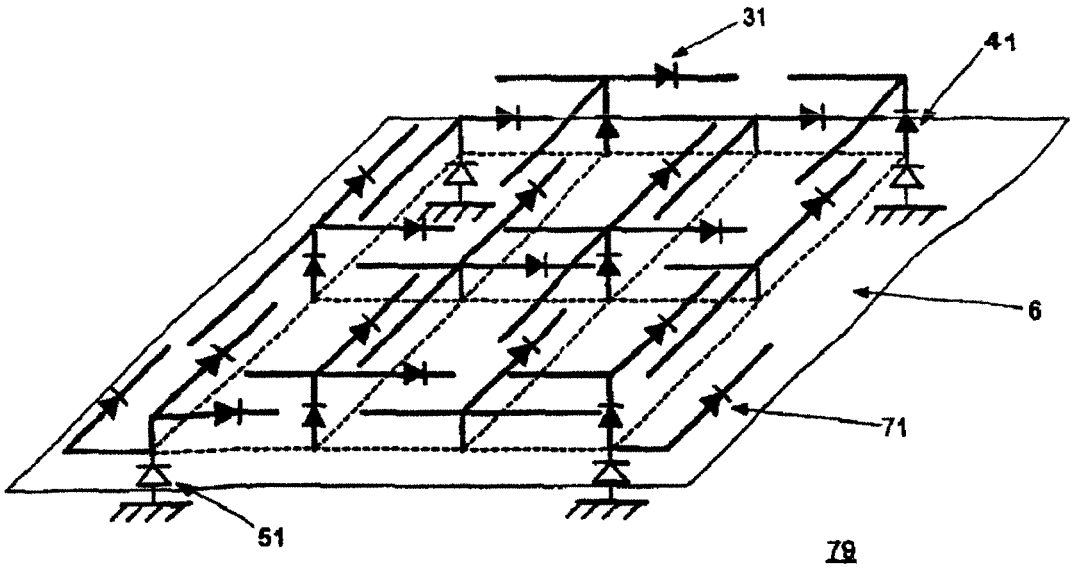
FIG. 13 illustrates a three dimensional view of one embodiment of a structure comprising multiple capacitively loaded magnetic dipoles, sharing common areas with control elements placed in different areas.

FIG. 13 illustrates a three dimensional view of one embodiment of an antenna (79) which comprises multiple capacitively loaded magnetic dipole antennas. In one embodiment, individual dipole antennas share common areas with one or more control elements placed in the capacitive area, inductive area, matching area, and/or stub area of one or more of the dipole structures, for example, control elements (31, 41, 51, 71). Such a complex structure effectuates coverage of multiple frequency bands and can provide an optimized solution in terms of input impedance, radiated power and beam direction. In one embodiment, multiple capacitively magnetic dipole antennas can be arranged to offer selection of different configuration solutions in real time. For example, in one embodiment, wherein the human body influences reception or transmission of wireless communications, one or more antenna could be actively substituted for other antennas to improve the real time reception or transmission of a communication.

Figure 14A:
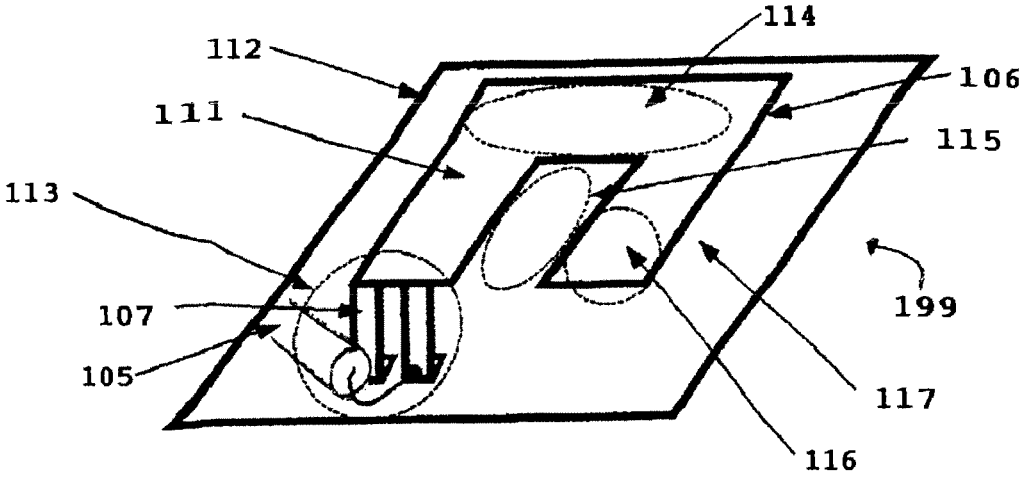
FIG. 14A illustrates a three dimensional view one embodiment of an antenna.
Figure 14B:
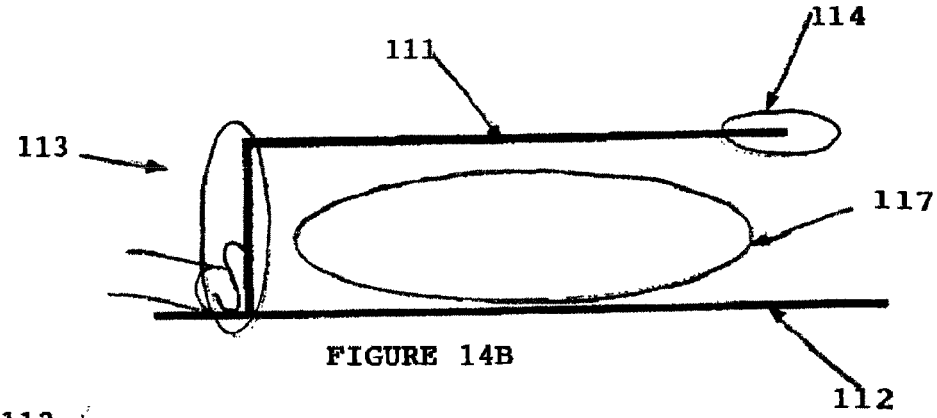
FIG. 14B illustrates a side-view of one embodiment of an antenna.
Figure 14C:
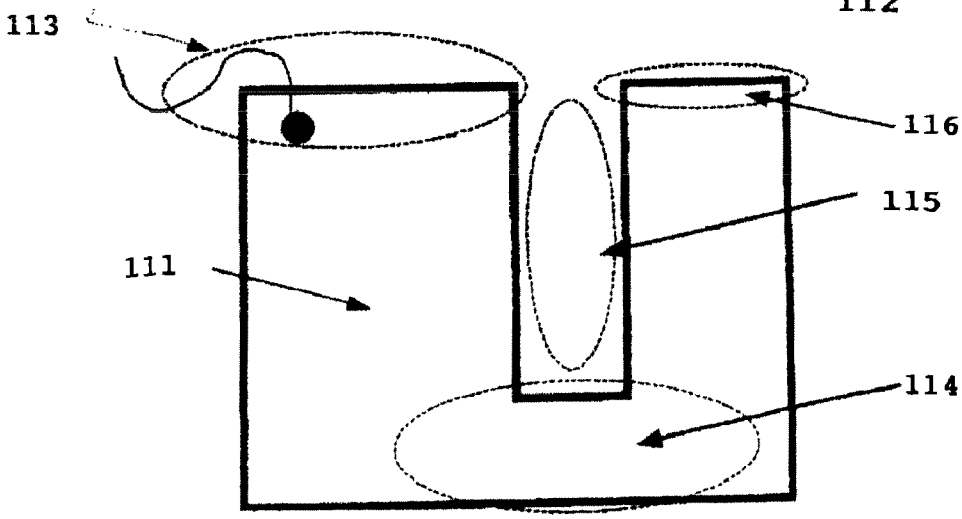
FIG. 14C illustrates a bottom-view of a top portion of one embodiment of an antenna.

FIGS. 14*a*, 14*b*, and 14*c* illustrate respective three-dimensional, side, and bottom views of one embodiment of one or more portions of a capacitively loaded magnetic dipole antenna (199). In one embodiment, antenna (199) comprises a top portion (106) disposed opposite a ground plane portion (112), with the top portion (106) coupled to the ground plane portion (112) by a ground connection portion (107). In one embodiment, a generally planar disposition of the top portion (106) and an opposing generally planar disposition of the ground portion (112) define a first gap area (117). In one embodiment, ground portion (112) is coupled to top portion (106) by ground connection portion (107) in an area indicated generally as feed area (113). In one embodiment, ground portion (112) comprises a ground plane. In one embodiment, within the feed area, a signal feed line portion (105) is coupled to the top portion (106). In one embodiment, the top portion (106) comprises a first portion (116) and a second portion (111), with the first portion coupled to the second portion by a connection portion (114). In one embodiment, first portion (116) and second portion (111) are opposingly disposed in a plane and define a second gap area (115). In one embodiment, one or more portion (105), (107), (111), (112), (114), and (116) may comprise conductors. In one embodiment, one or more portion (105), (107), (111), (112), (114), and (116) may comprise conductive flat plate structures. It is understood, that top portion (106) and ground plane (112) may comprise other than flat-plate structures. For example, one or more portion, (105), (107), (111), (112), (114), and (116) may comprise rods, cylinders, etc. It is also understood that the present invention is not limited to the described geometries, as in other embodiments the top portion (106), the ground plane (112), the first portion (116), and the second portion (111) may be disposed relative to each other in other geometries. For example, top conductor (106) may be coupled to ground plane portion (112), and first portion (116) may be coupled to second portion (111) such that one or more of the portion are in other than parallel relationships. Thus, it is understood that antenna (199), as well as other antennas described herein, may vary in design and yet remain within the scope of the claimed invention.

As will be understood with reference to the foregoing Description and Figures, one or more of portions (105), (107), (111), (112), (114), and (116), as well as other described further herein, may be utilized to effectuate changes in the operating characteristics of a capacitively loaded magnetic dipole antenna. In one embodiment, one or more of portions (105), (107), (111), (112), (114), and (116) may be utilized to alter the capacitive and/or inductive characteristics of a capacitively loaded magnetic dipole antenna design. For example, one or more of portions (105), (107), (111), (112), (114), and/or (116) may be utilized to reconfigure impedance, frequency, and/or radiation characteristics of a capactively loaded magnetic dipole antenna.

Figure 15:
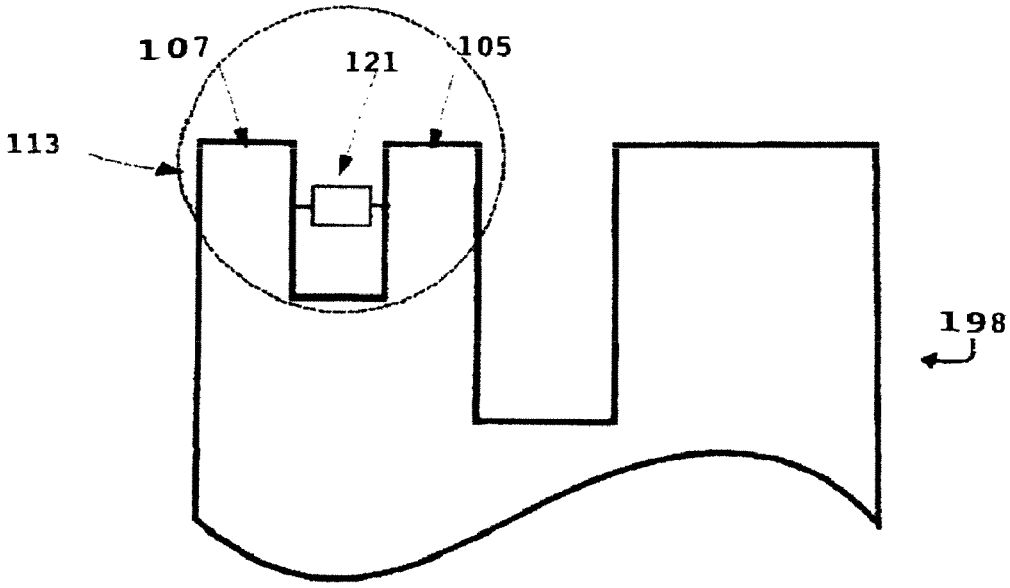
FIG. 15 illustrate views of one embodiment of an antenna and a control portion.

FIG. 15 illustrate respective side and bottom views of one embodiment of one or more portion of a capacitively loaded magnetic dipole antenna (198), wherein antenna (198) further comprises a control portion (121). In one embodiment, control portion (121) is disposed generally within the feed area (113). In one embodiment, control portion (121) is electrically coupled at one end to the feed line portion (105) and at another end to ground connection portion (107). In one embodiment, control portion (121) comprises a device that may exhibit ON-OFF and/or actively controllable capacitive/inductive characteristics. In one embodiment, control portion (121) may comprise a transistor device, an FET device, a MEMs device, or other suitable control portion or circuit capable of exhibiting ON-OFF and/or actively controllable capacitive/inductive characteristics. In one embodiment wherein the control portion (121) comprises a switch with ON characteristics, a Smith Chart loop, as used by those skilled in the art for impedance matching, is smaller than when the control portion (121) exhibits OFF characteristics. It has been identified that use of a control portion (121) with ON characteristics in the feed area (113) may be used to actively compensate for external influences on the antenna (198), for example, as by a human body. In one embodiment, wherein the capacitance/inductance of control portion (121) may be actively changed, for example, by a control input to a connection of an FET device or circuit connected between feed line (105) and connector portion (107), the control portion (121) may be used to effectuate changes in the inductance or capacitance of the antenna (198). It has been identified that the capacitance/inductance of the control portion (121) may be varied to actively change the LC characteristics of antenna (198) such that the impedance and/or resonant frequency of the antenna (198) may be actively re/configured.

Figure 16A:
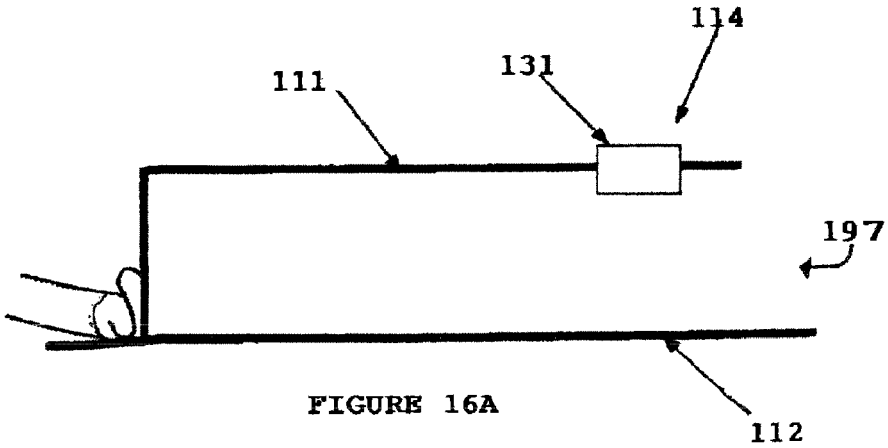
FIGS. 16A-B illustrate views of one embodiment of an antenna and a control portion.
Figure 16B:
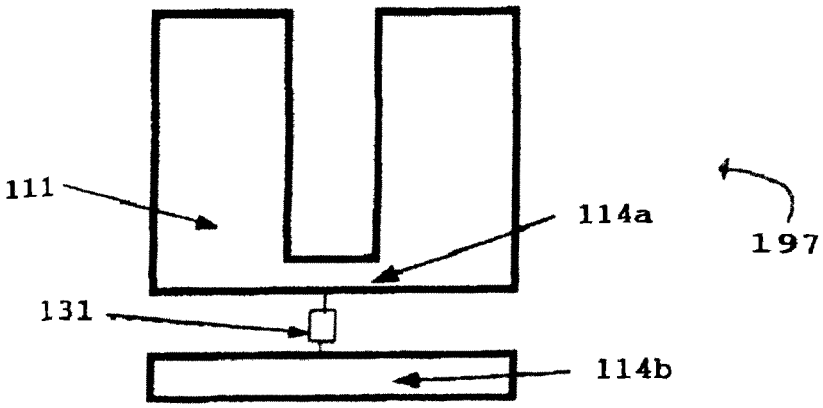

FIGS. 16A, 16B, and 16C illustrate respective side sectional, and bottom views of one embodiment of one or more portions of a capactively loaded magnetic dipole antenna (197), wherein antenna (197) further comprises a control portion (131). In one embodiment, control portion (131) is disposed in an area generally defined by connection portion (114). In the one embodiment, connection portion (114) comprises a first part (114*a*) coupled to a second part (114*b*). In one embodiment, first part (114*a*) is coupled to second part (114*b*) by the control portion (131). In one embodiment, wherein the control portion (131) comprises a switch that exhibits ON characteristics, it is understood that the first and second parts of connection portion (114) may be electrically connected to each other to effectuate a larger surface geometry than in an embodiment wherein the cored portion exhibits OFF characteristics.

It has been identified that with a control portion (131) coupled to connection portion (114) in a manner as generally described herein, a connection portion (114) may comprise a larger surface area and the resonant frequency of antenna (197) may thus be lowered. In one embodiment, the operating frequency of antenna (197) may be actively changed from one frequency to another, for example, between a 800 MHz band used in the US and a 900 MHz band used in Europe for cell-phone transmitting and receiving applications. In one embodiment, wherein the capacitance and/or inductance of the control portion (131) may be actively changed, for example, by a control input to a connection of an FET device or circuit connected between the first part (114*a*) and the second part (114*b*), it has also been identified that the capacitance and/or inductance of the control portion (131) may be varied to change the LC characteristics of antenna (197) such that the resonant frequency of the antenna (197) may be actively re/configured.

Figure 17A:
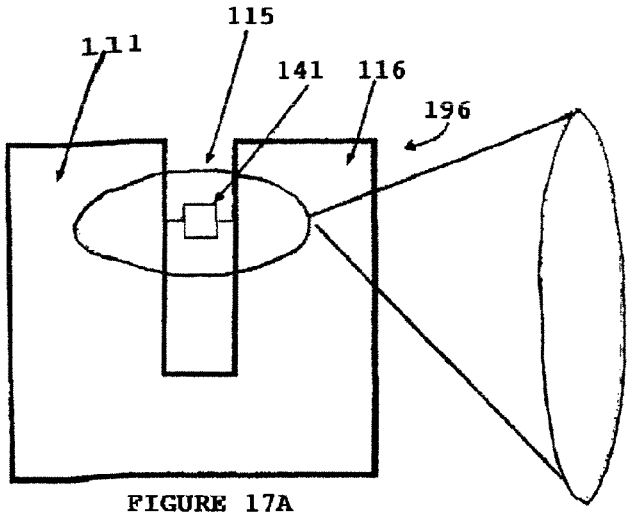
FIGS. 17A-D illustrate views of an antenna and a control portion.
Figure 17B:
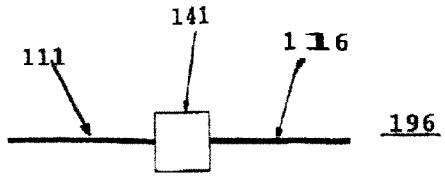

FIGS. 17A and 17B illustrate respective bottom and front-side-sectional views of one embodiment of one or more portions of a capacitively loaded magnetic dipole antenna (196), wherein antenna (196) further comprises a control portion (141) disposed in the general area of the second gap area (115). In one embodiment, control portion (141) is electrically coupled at one end to first portion (116) and at another end to second portion (111). In one embodiment, with a control portion (141) that exhibits ON characteristics, first portion (116) nay be electrically coupled to second portion (111) so as to increase the frequency and the bandwidth of the antenna (196), compared to an embodiment where the control portion (141) exhibits OFF characteristics. In one embodiment, wherein the capacitance and/or inductance of the control portion (141) may be actively charged, the electrical coupling between the first portion (116) and the second portion (111) may be continuously controlled to effectuate changes in the inductance and/or capacitance in the second gap area (115). It has been identified that with a control portion (141) disposed generally in the gap (115) area, the resonant frequency, the bandwidth, and/or the antenna impedance characteristics may be actively re/configured.

Figure 17C:
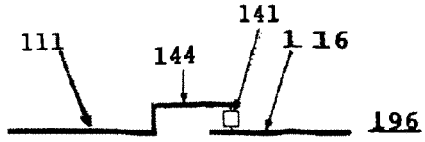

FIG. 17C illustrates a front-side-sectional view of one embodiment of one or more portion of a capactively loaded magnetic dipole antenna (196), wherein antenna (196) further comprises a bridge portion (144) and a control portion (141) disposed in the general area of the second gap area (115). In one embodiment, bridge portion (144) is coupled to the second portion (111) to extend an area of the second portion over the first portion (116). In one embodiment, the control portion (141) is coupled at one end to the bridge portion (144) and at another end to the first portion (116).

Figure 17D:
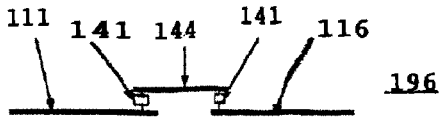

FIG. 17D illustrates a front-side-sectional view of one or more portion of a capactively loaded magnetic dipole antenna (196), wherein antenna (196) further comprises a bridge portion (144) and two control portions (141) disposed in the general area of the second gap (115). In one embodiment, bridge portion (144) is disposed to extend over an area of the first portion (116) and over an area of the second portion (111). Bridge portion (144) is coupled to the first portion (116) by a first control portion (141) and to the second portion (111) by a second control portion (141). It has been identified that the control portion(s) (141) of the embodiments illustrated by FIGS. 17C and 17D maybe disposed generally in the gap (115) area to effectuate active control of resonant frequency, bandwidth, and impedance characteristics of antenna (196).

Figure 18:
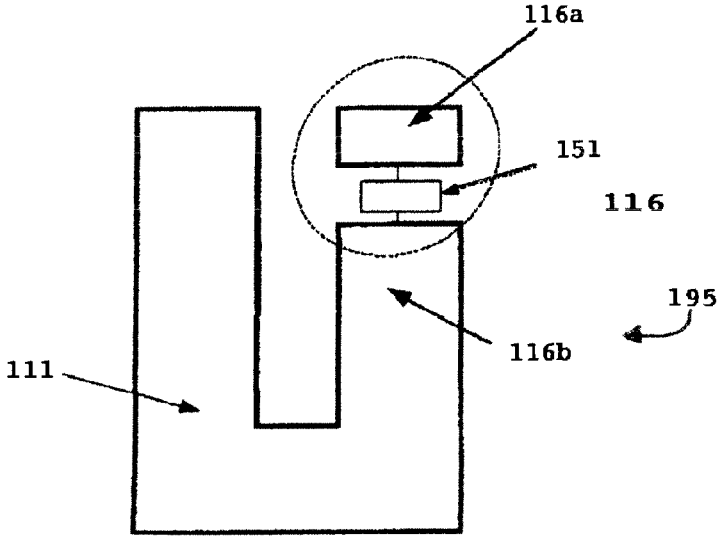
FIG. 18 illustrates a view of one embodiment of an antenna and a control portion.

FIG. 18 illustrates a bottom view of one embodiment of one or more portion of a capacitively loaded magnetic dipole antenna (195), wherein antenna (195) further comprises a control portion (151) disposed in the general area of the first portion (116). In one embodiment, first portion (116) comprises a first part (116*a*) and a second part (116*b*), with the first part coupled to the second part by the control portion (151). In one embodiments control portion (151) is coupled at one end to first part (116*a*) and at another end to second part (116*b*) such that when control portion (151) exhibits ON characteristics, the area of first portion (116) may be effectively increased. It has been identified that with a control portion (151) that exhibits ON characteristics, the resonant frequency of antenna (195) is lower than with a control portion (151) that exhibits OFF characteristics, for example, 800 MHz vs. 900 MHz. It has also been identified with a control portion (151), wherein the capacitance and/or inductance may be changed, the resonant frequency of antenna (195) may be actively reconfigured.

Figure 19:
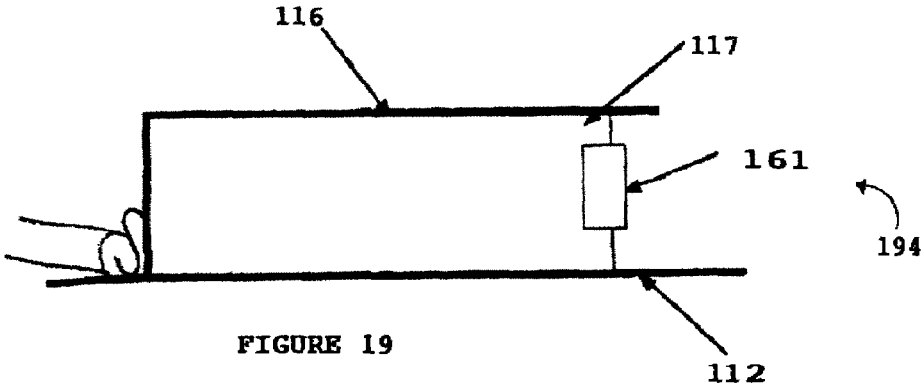
FIG. 19 illustrates a view of one embodiment of an antenna and a control portion.

FIG. 19 illustrates a side view of one embodiment of one or more portion of a capacitively loaded magnetic dipole antenna (194), wherein antenna (194) further comprises a control portion (161) disposed generally in the first gap area (117) defined by the first portion (116) and the ground plane (112). It has been identified, wherein control portion (161) is coupled at one end to the first portion (116) and at another end to the ground plane (112), that when control portion (161) exhibits ON characteristics, the antenna (194) may be switched off. It has also been identified, wherein the capacitance and/or inductance of the control portion (161) may be actively changed, that the resonant frequency or impedance of antenna (194) may be actively reconfigured.

Figure 20:
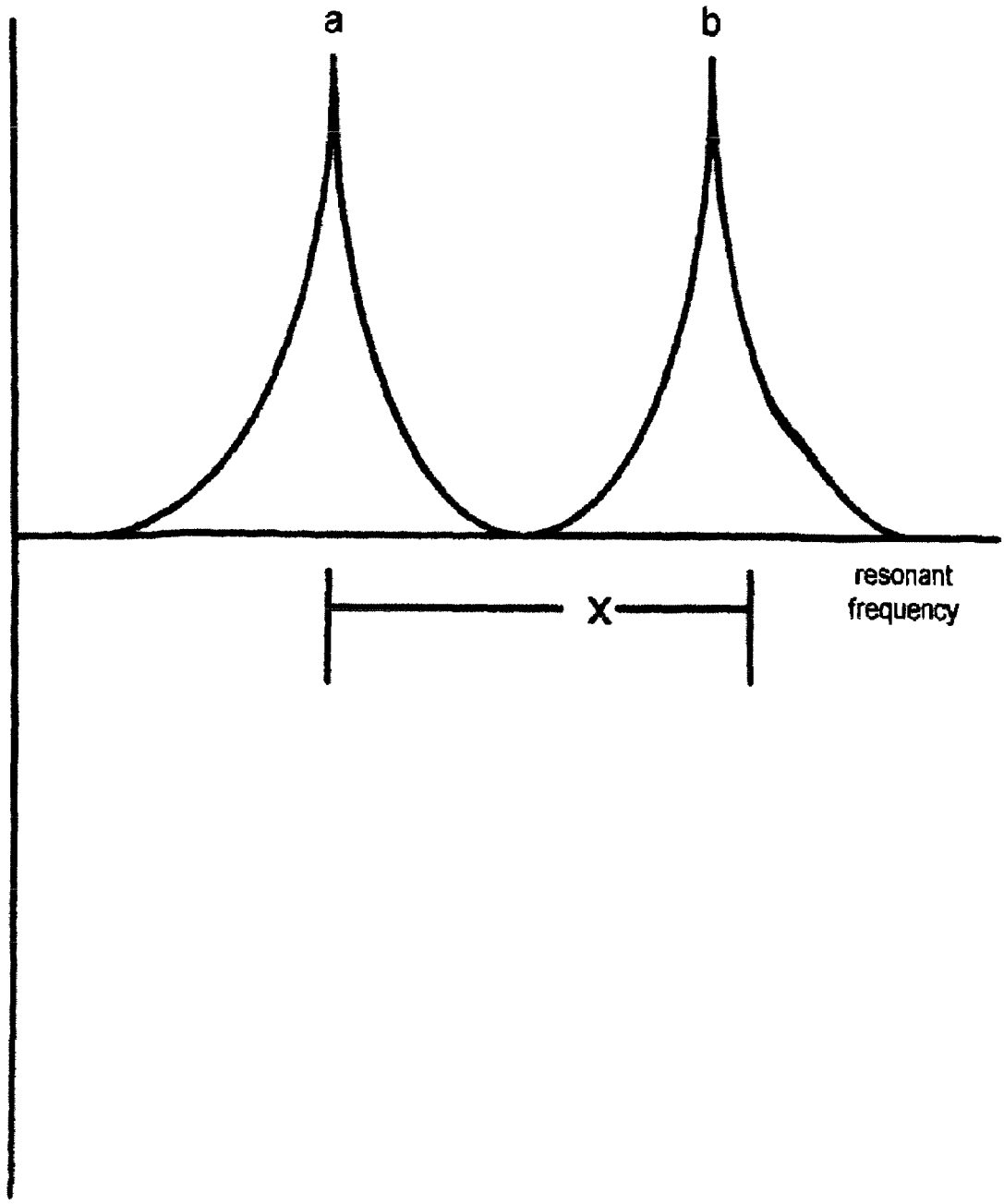
FIG. 20 illustrates resonant frequencies of a dual band capacitively loaded magnetic dipole antenna.

FIG. 20 illustrates resonant frequencies of a dual band capacitively loaded magnetic dipole antenna, wherein the antenna is provided with an additional resonant frequency by including one or more additional portion and/or gap in a low current density portion of the antenna. In one embodiment, a capacitively loaded magnetic dipole antenna may be provided with a lower resonant frequency (a) that spans a lower frequency band at its 3 db point and an upper resonant frequency (b) that spans an upper frequency band at its 3 db point, both resonant frequencies separated in frequency by (X), and both resonant frequencies determined by the geometry of one or more portion and/or gap as described further herein. In different embodiment it is possible to actively reconfigure antenna characteristics in either their upper frequency band or their lower frequency band, or both, by disposing control portions in accordance with principles set out forth in the descriptions provided further herein.

Figures 21A, 21B, 21C:
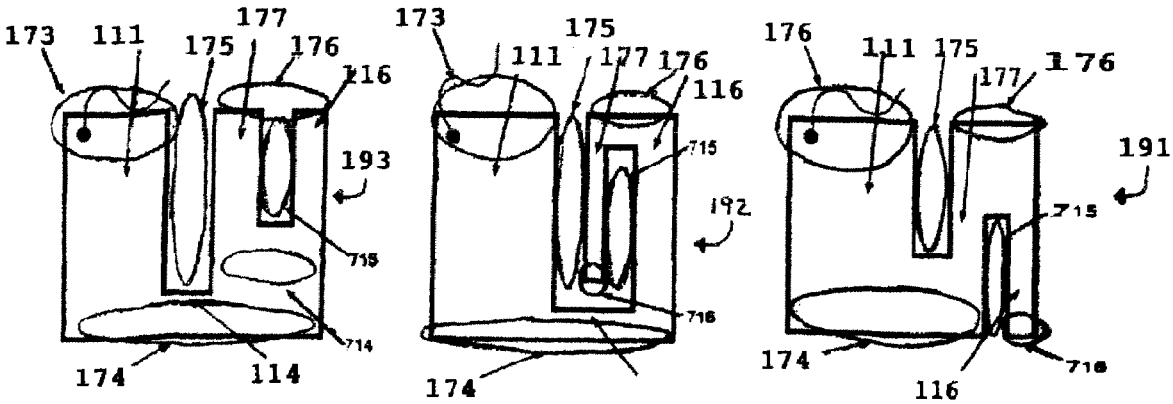
FIGS. 21A-C illustrate views of one embodiment of an antenna and a control portion.

FIG. 21A illustrates a bottom view of one or more portion of one embodiment of a dual band capacitively loaded magnet dipole antenna (193), wherein antenna (193) comprises a control portion (not shown) disposed in one or more of area (173), area (174), area (175) and area (176), area (714), and area (715). It is understood that although FIGS. 21A-C describe embodiments wherein one additional portion and/or additional gap are included to comprise a dual band antenna, the present invention is not limited to these embodiments, as in other embodiments more than one additional portion and/or more than one additional gap may be provided to effectuate creation of one or more additional resonant frequency in a capacitively loaded magnetic dipole antenna. In one embodiment, the third portion (177) is coupled to a connection portion (114), and is disposed between a first portion (116) and a second portion (111). The third portion (177) enables antenna (193) to operate at two different resonant frequencies separated in frequency by (X). It is understood that when (X) approaches zero, changes made to affect antenna characteristics at one resonant frequency may affect characteristics at another resonant frequency. It has been identified that a control portion used in area (173) may be used to control the impedance of the antenna (193) in both resonant frequency bands. The areas (174, 175) provide similar function to that of the respective portion and gap of a single band antenna for a lower resonant frequency band. A control portion coupled to antenna (193) in area (176) may be used to affect characteristics of the antenna (193) in both lower and upper resonant frequency bands. Finally, it has been identified that the areas (714, 715) act to affect an upper resonant frequency band in a manner similar to the portion and gap of a single band antenna.

FIG. 21B illustrates a bottom view of one or one portion of a dual band capacitively loaded magnetic dipole antenna (192), wherein antenna (192) comprises a control portion (not shown) disposed in one or more of area (173), area (174), area (175), area (176), area (715), and area (716). In one embodiment, the third portion (177) is coupled to the first portion (116), and is disposed between first portion (116) and second portion (111). The third portion (177) enables antenna (192) to operate at one or both of an upper and lower resonant frequency. It has been identified that a control portion may be used in area (173) to control the impedance of the antenna (192) in either the lower or the upper frequency band. The areas (174, 175, 176) provide similar function to that of respective gap and portions of a single band antenna for a lower frequency band. It has been identified that the influence of area (176) over an upper frequency band is reduced. It has also been identified that the areas (715, 716) act to affect an upper frequency band in a manner similar to the gap and portion of a single band antenna. Finally, it has also been identified that characteristics of the antenna (192) may be altered in a lower frequency band independent of the characteristics in an upper frequency band.

FIG. 21C illustrates a bottom view of one or more portion of a dual band capacitively loaded magnetic dipole antenna (191), wherein antenna (191) comprises a control portion (not shown) disposed in one or more of area (173), area (174), area (175), area (176), area (715), and area (716). In one embodiment, the third portion (177) is disposed between a first portion (116) and a second portion (111). Third portion (177) is coupled at one end to the first portion (116) by a first connection portion and at a second end to the second portion (111) by a second connection portion. The third portion (177) enables antenna (191) to operate in one or both of two different resonant frequency bands. It has been identified that a control portion may be used in area (173) to control the impedance of the antenna (191) in either a lower or upper frequency band. The areas (174, 175, 176) provide similar function to that of respective gap and portions of a single band antenna for a lower frequency band. It has been identified that the influence of area (176) over an upper frequency band is reduced. It has also been identified that the areas (715, 716) act to affect an upper frequency band in a manner similar to the gap and portion of a single band antenna. Finally, it has also been identified that characteristics of the antenna (191) may be altered in a lower frequency band independent of the characteristics in an upper frequency band.

Figure 22A:
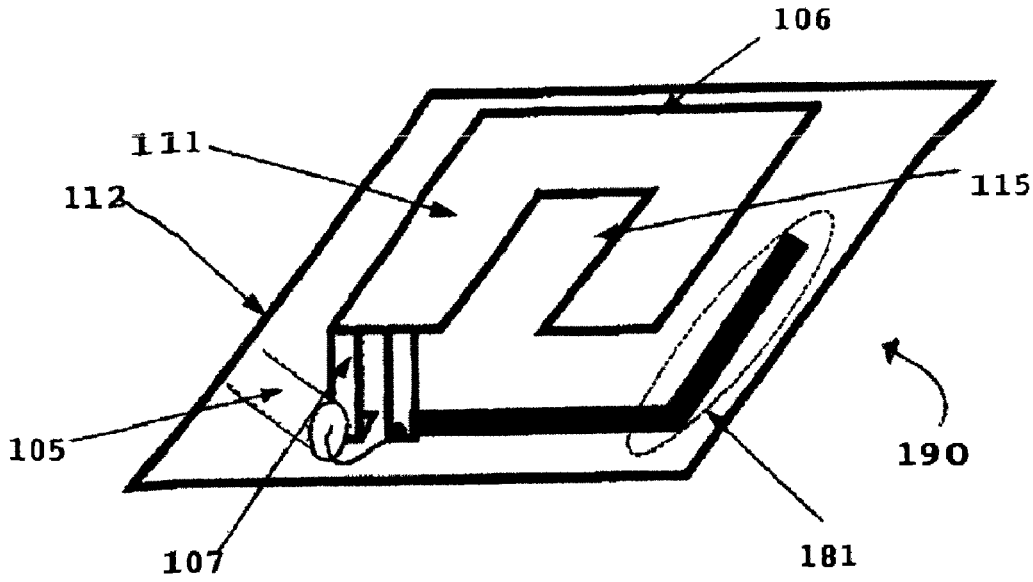
FIGS. 22A-B illustrate views of one embodiment of an antenna and a stub.

FIG. 22A illustrates a three-dimensional view of one or more portion of one embodiment of a capacitively loaded magnetic dipole antenna (190), wherein antenna (190) further comprises a stub (181). It has been identified that with a stub (181) coupled to an antenna in the feed area, for example, to a ground connection portion (107) or to a feed line (105), a gap may be defined between the stub and a portion of the antenna such that an additional lower or upper antenna resonant frequency is created. By changing characteristics of the stub as described herein, it is possible to control an antenna's characteristics, for example, its impedance and lower/upper resonant frequency. In one embodiment, stub (E1) comprises a printed line disposed on ground plane portion (112) and defines a gap between the stub and one or more portion of antenna (190). In one embodiment, stub (181) comprises a right angle geometry, but it is understood that stub (181) may comprise other geometries, for example straight, curved, etc. In one embodiment, stub (181) may be implemented with various technologies, for example, technologies used to create micro-strip lines or coplanar-waveguides as practiced by those skilled in the art. In one embodiment, stub (181) impedance measures 50 ohms, but other impedances are also within the scope of the present invention.

Figure 22B:
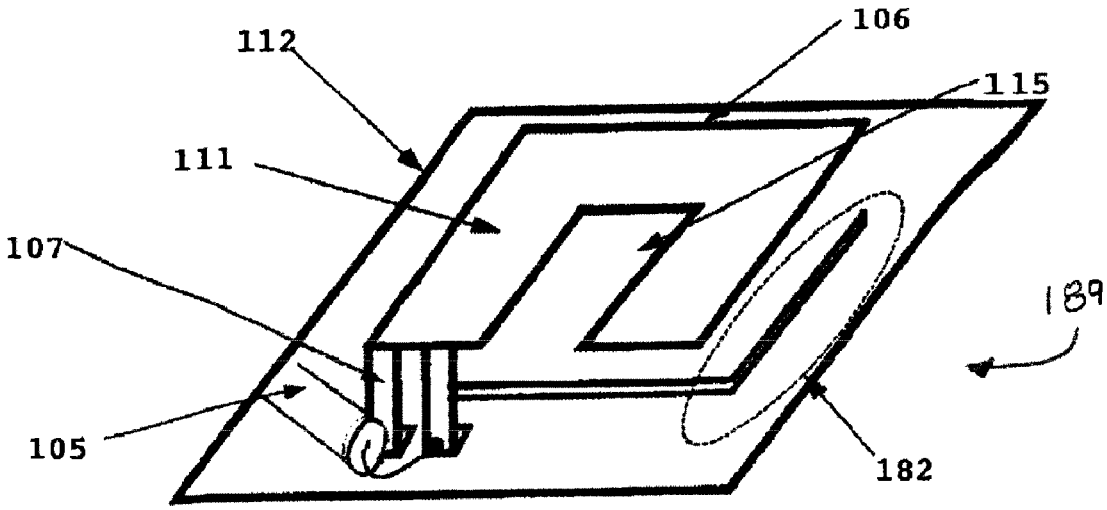

FIG. 22B illustrates a three-dimensional view of one or more portion of one embodiment of a capacitively loaded magnetic dipole antenna (189), wherein antenna (189) further comprises a stub (182) coupled to a ground connection portion (107) or to a feed line (105). In one embodiment, stub (182) is disposed above the ground plane portion (112) and below one or more portions of antenna (189). In one embodiment, stub (182) may be disposed in such a way to couple directly to portion (111). In one embodiment, stub (182) comprises a right angle geometry, but it is understood that stub (182) may comprise other geometries, for example straight or curved.

Figure 23A:
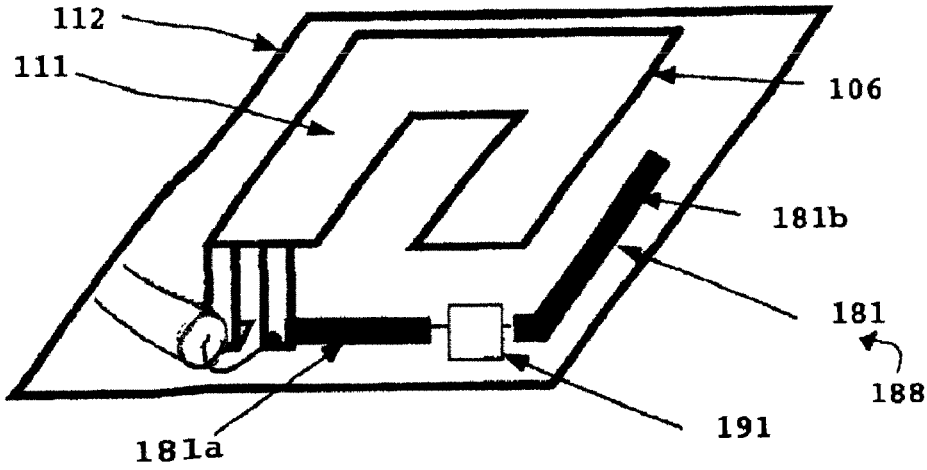
FIGS. 23A-B illustrate views of one embodiment of an antenna, a control portion, and a stub.

FIG. 23A illustrates a three-dimensional view of one or more portion of one embodiment of a capacitively loaded magnetic dipole antenna (188) similar to that illustrated by FIG. 21*a*, wherein antenna (188) comprises a stub (181) and a control portion (191). In one embodiment, control portion (191) is disposed to couple a first portion (181*a*) to a second portion (181*b*) of stub (181). In has been identified that a control portion (191) that exhibits ON characteristics may be utilized to increase the length of stub (181), as compared to a control portion that exhibits OFF characteristics. It is identified that control portion (191) may thus enable control of an antenna resonant frequency created by the stub. It has also been identified that if the resonant frequency created by stub (181) is sufficiently close to the resonant frequency created by the top portion (106), control portion (191) may be used to effectuate changes in the resonant frequency or antenna characteristics created by the top portion.

Figure 23B:
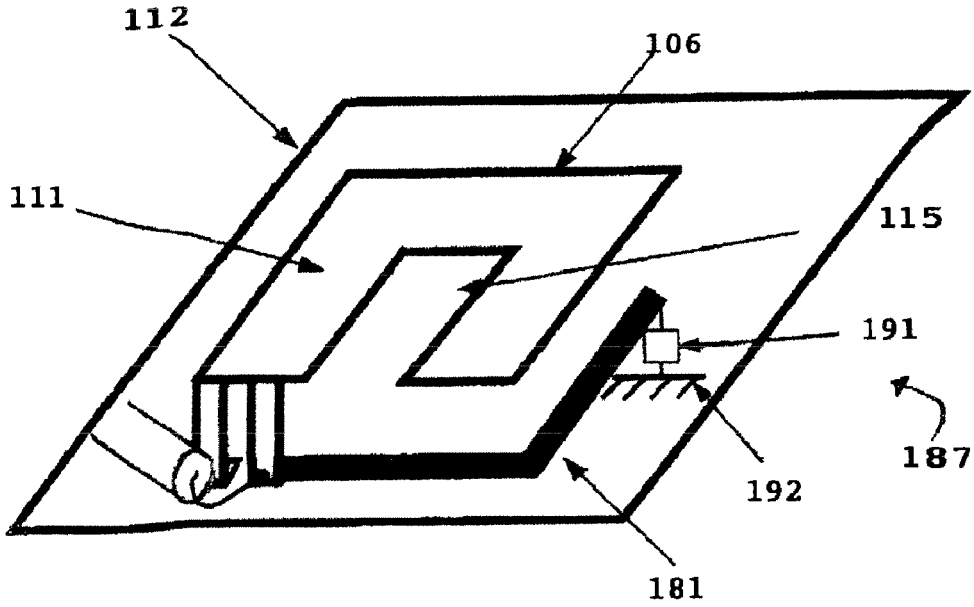

FIG. 23B illustrates a three-dimensional view of one or more portion of one embodiment of a capacitively loaded magnetic dipole antenna (187), wherein antenna (187) comprises a stub (181) and control portion (191). In one embodiment, control portion (191) is disposed to couple stub (181) to the ground plane (112). It is identified that use of control portion (191) may thus enable control of an antenna resonant frequency created by the stub. It has also been identified that if the resonant frequency created by stub (181) is sufficiently close to the resonant frequency created by the top portion (106), control portion (191) may be used to effectuate changes in the resonant frequency or antenna characteristics created by the top portion.

Figure 24A:
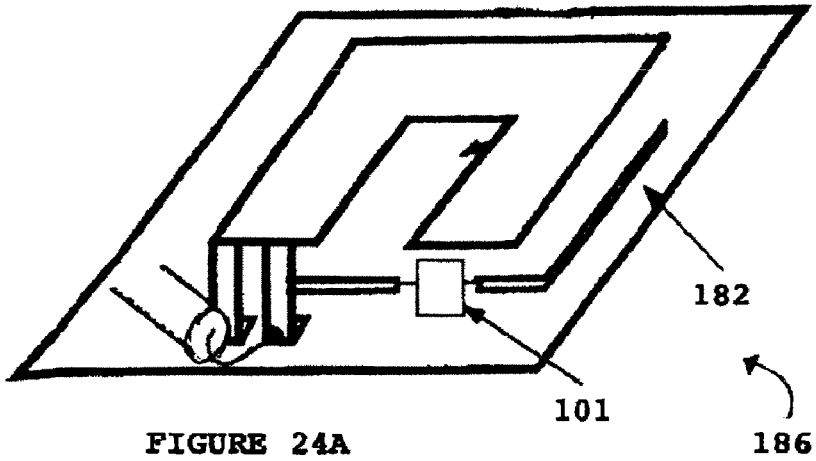
FIGS. 24A-C illustrate views of one embodiment of an antenna, a control portion, and a stub.

FIG. 24A illustrates a three-dimensional view of one or more portion of one embodiment of a capacitively loaded magnetic dipole antenna (186) wherein the antenna comprises a stub (182) and further comprises a control portion (201) disposed to couple one part of the stub to another part of the stub. It has been identified that control portion (201) may be used to effectuate changes in the electrical length of a stub (182). It is identified that use of a control portion (201) may thus enable control of an antenna resonant frequency created by the stub. It has also been identified that if the resonant frequency created by stub (201) is sufficiently close to the resonant frequency created by the top portion (106), control portion (201) may be used to effectuate changes in the resonant frequency or antenna characteristics created by the top portion.

Figure 24B:
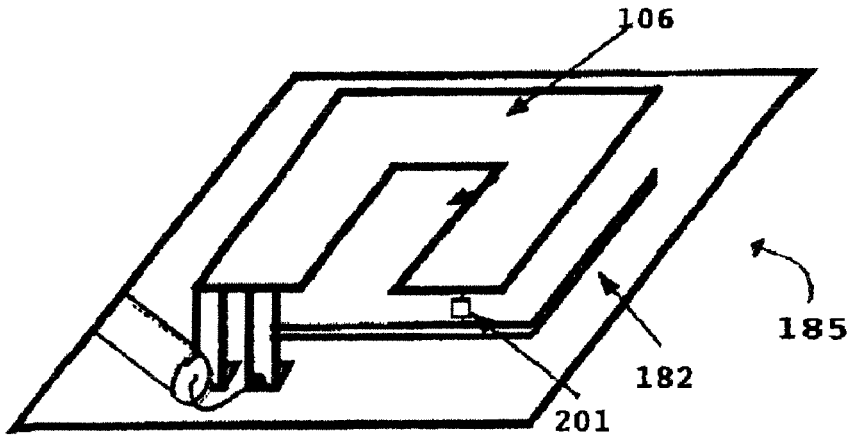

FIG. 24B illustrates a three-dimensional view of one or more portion of one embodiment of a capacitively loaded magnetic dipole antenna (185), wherein the antenna comprises a stub (182) and further comprises a control portion (201) coupled to connect the stub (182) to portion (106) of antenna (185). It is identified that control portion (201) maybe used to effectuate active control of characteristics of antenna (185).

Figure 24C:
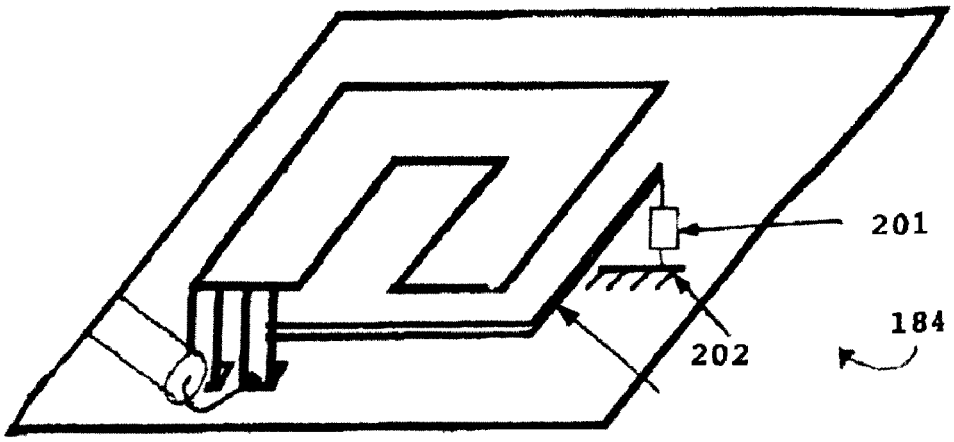

FIG. 24C illustrates a three-dimensional view of one or more portion of a capacitively loaded magnetic dipole antenna (184), wherein the antenna comprises a stub (184) and a control portion (201) connected between the stub and a ground point (202) on the ground plane portion (112). It has been identified that the influence of the stub on the characteristics of the antenna is more drastic when the control portion (201) exhibits ON characteristics than when the control portion exhibits OFF characteristics.

It is identified that capacitively loaded magnetic dipole antennas may comprise more than one control portion to effectuate independent control of one or more characteristics of a capacitively loaded magnetic dipole antenna, for example independent control of multiple resonant frequencies of a multiple band antenna.

Figure 25:
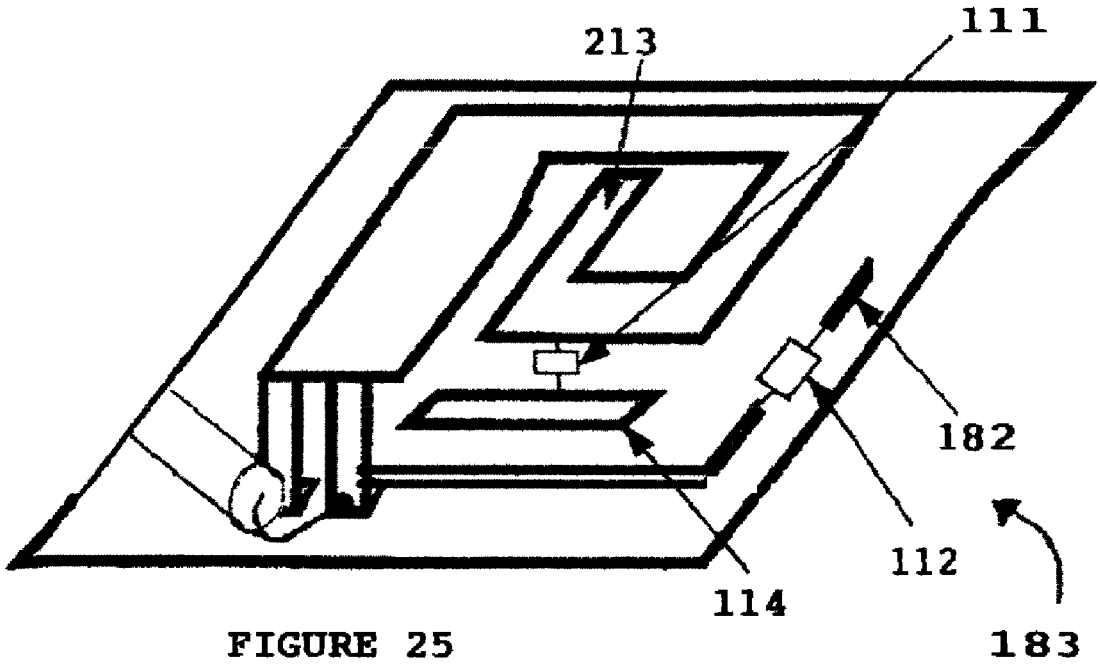
FIG. 25 illustrates a perspective view of one embodiment of an antenna, control portions, and a stub.

FIG. 25 illustrates a three-dimensional view of one or more portion of one embodiment of a dual band capacitively loaded magnetic dipole antenna (183), comprising a control portion (211), a control portion (212), a reconfigurable area (114), and a third portion (213). In one embodiment, antenna (183) may further comprise a reconfigurable stub (182). It has been identified that control portion (211) has influence over a lower resonant frequency band. For example, by controlling the characteristics of control portion (211) it is possible to switch the antenna (183) from 800 MHz to 900 MHz. It has also been identified that control portion (212) on the stub (182) may be used to influence an upper resonant frequency band. For example, it is possible to switch antenna (183) from 1800 MHz to 1900 MHz.

Figure 26:
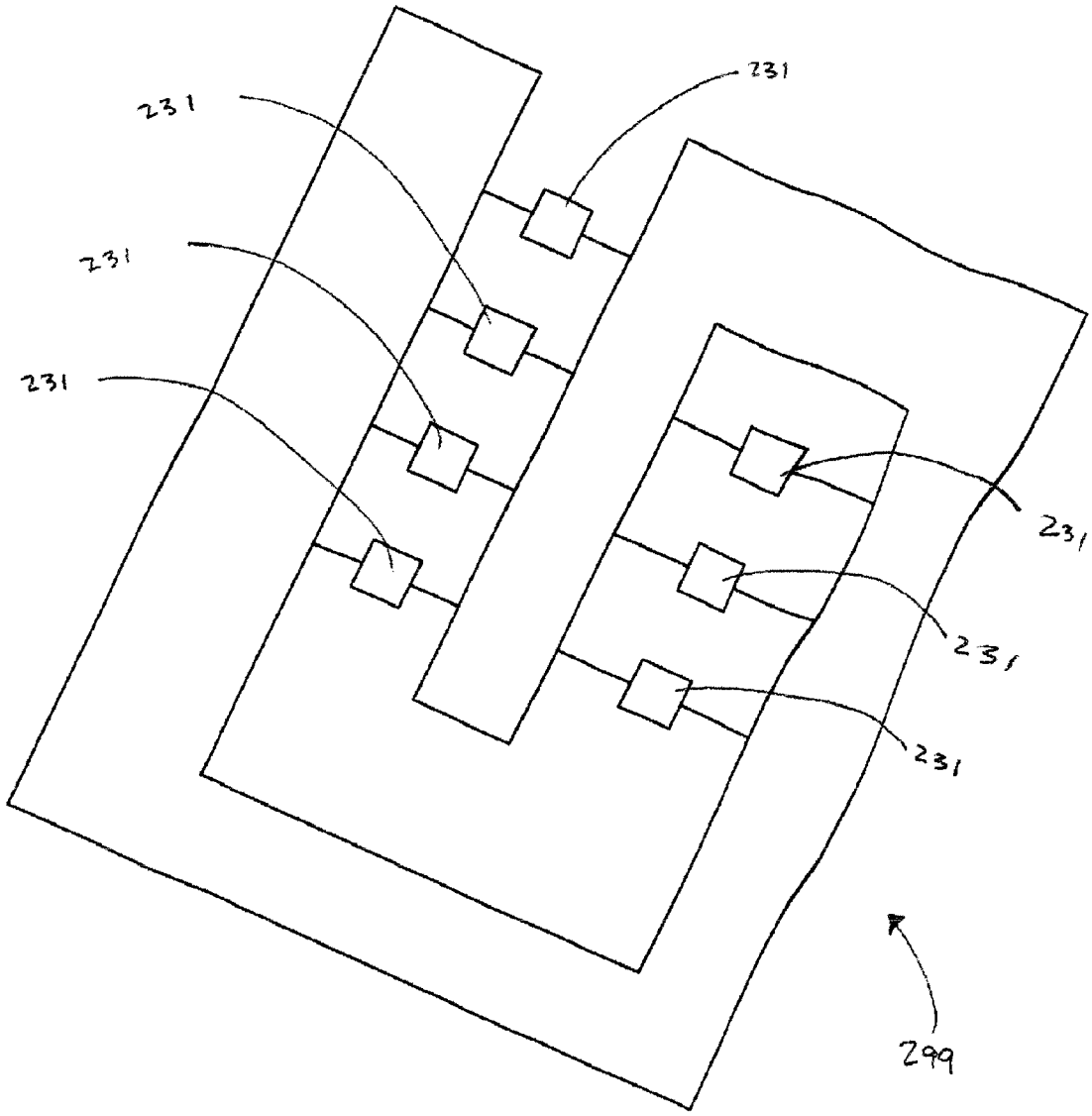
FIG. 26 illustrates a perspective view of another embodiment of an antenna with control elements.

FIG. 26 illustrates another embodiment of an antenna (299) according to one aspect of the present invention. In this embodiment, multiple control elements (231) can be electrically coupled to the antenna (299). These control elements (231) can comprise devices that may exhibit ON-OFF and/or actively controllable capacitive/inductive characteristics. In one embodiment, control elements (231) may comprise transistor devices, FET devices, MEMs devices, or other suitable control elements or circuits capable of exhibiting ON-OFF and/or actively controllable capacitive inductive characteristics. These control elements (231) may be switched ON or OFF or the capacitance or inductance may be changed to actively control the resonant frequency of the antenna (299). In this manner, it is possible to construct an antenna (299) that can resonate an multiple frequencies, such as 200 MHz, 400 MHz, 700 MHz, 800 MHz, 900 MHz, 1800 MHz, 1900 MHz, etc. As such, the antenna (299) can be configured to support low frequency applications, such as broadcast television, as well as higher frequency applications such as cellular communications.

Figure 27A:
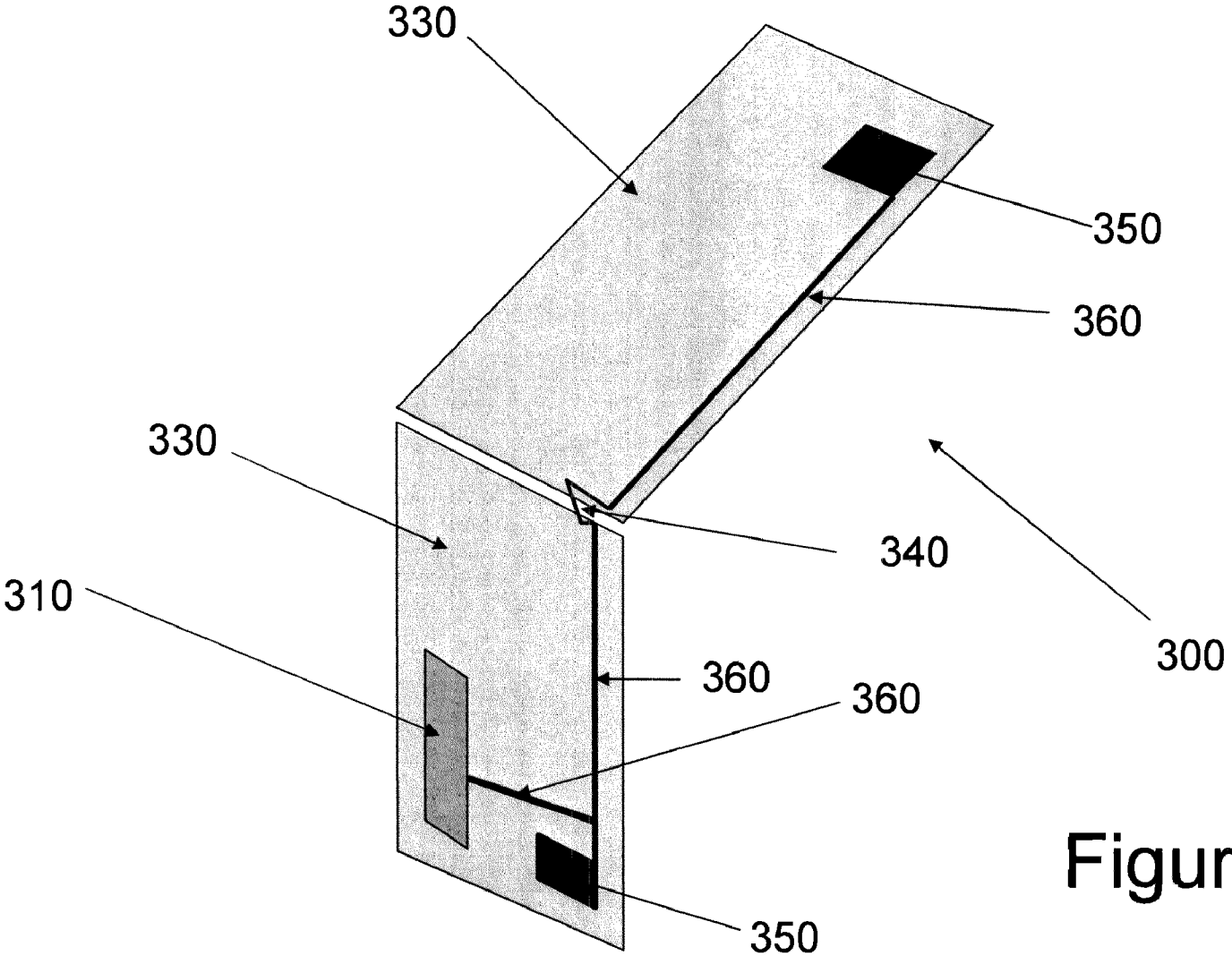
FIGS. 27A-H illustrate various embodiments of the invention including conductive pads and traces on the printed circuit board.

FIGS. 27A-H illustrate various embodiments of the invention in which conductive pads (350) and traces (360) on the printed circuit board (330) are used for connecting the antenna (310) with the conductive structure (320) in an electronic device (300). As shown in FIG. 27A, an electronic device (300) according to one embodiment of the invention can comprise a so-called "flip-phone" type mobile telephone. The sections of the device (300) can each include a printed circuit board (330) having conductive traces (360) connected by a flexible conductive connector (340) in the hinge area of the device (300). The conductive traces (360) can be used to connect the antenna (310) to conductive pads (350) on the printed circuit board (330).

Figure 27B:
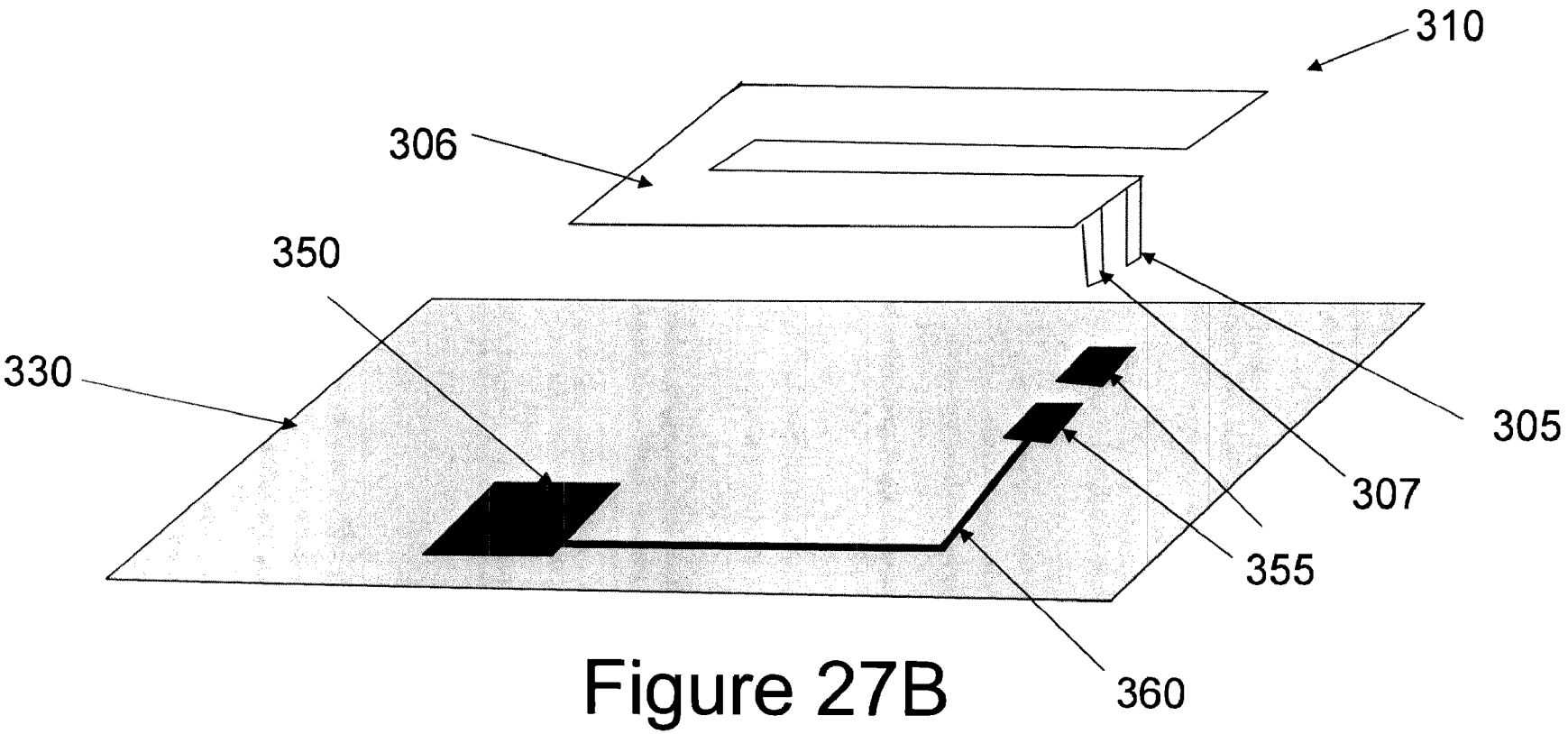
Figure 27C:
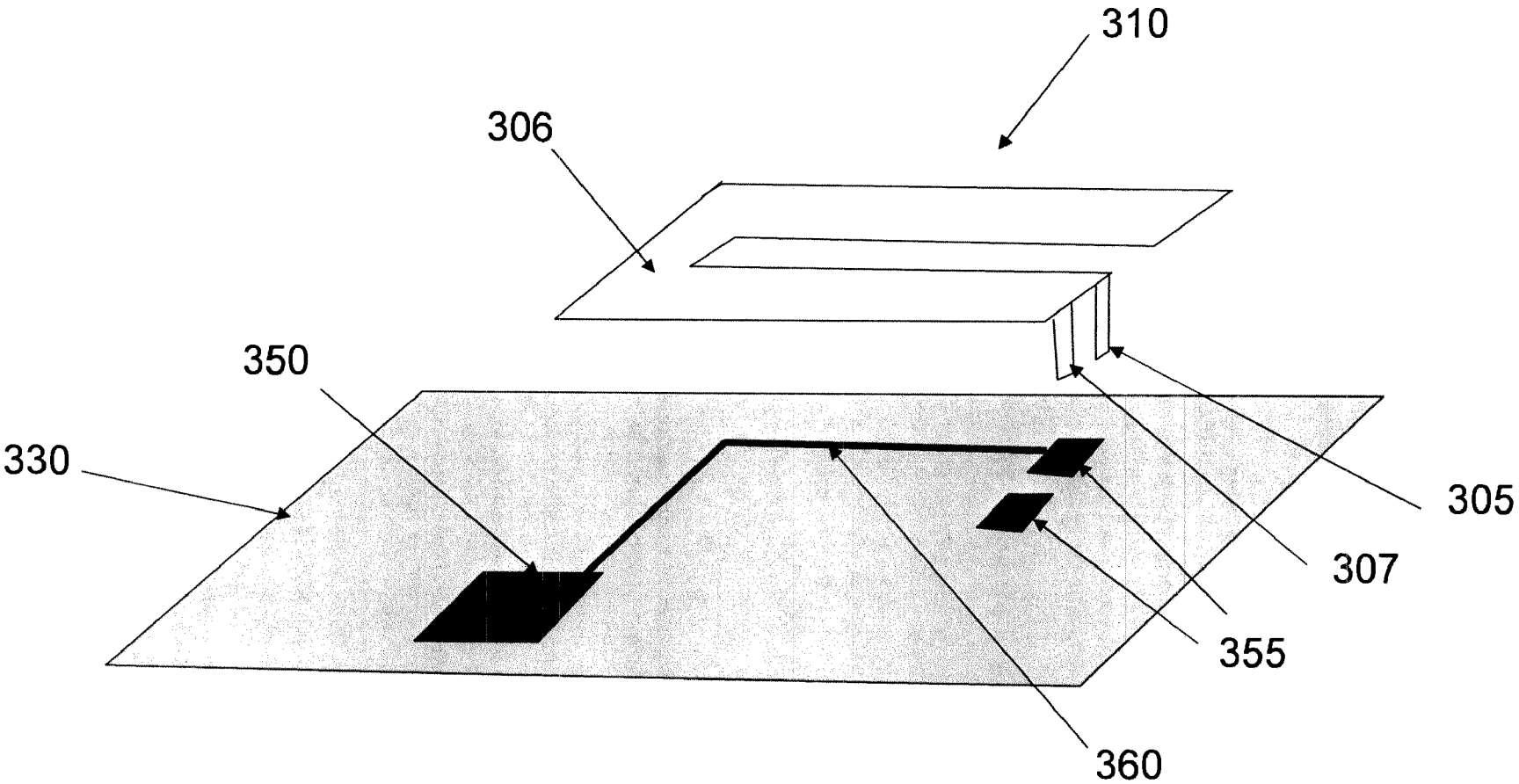
Figure 27D:
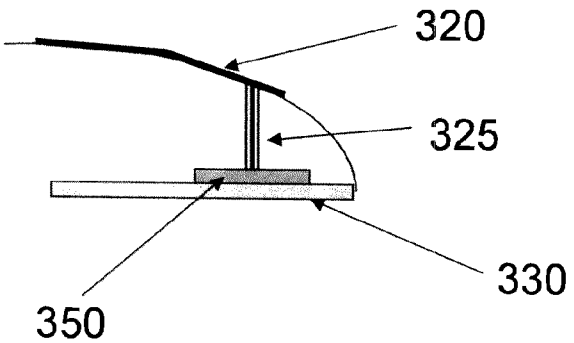
Figure 27E:
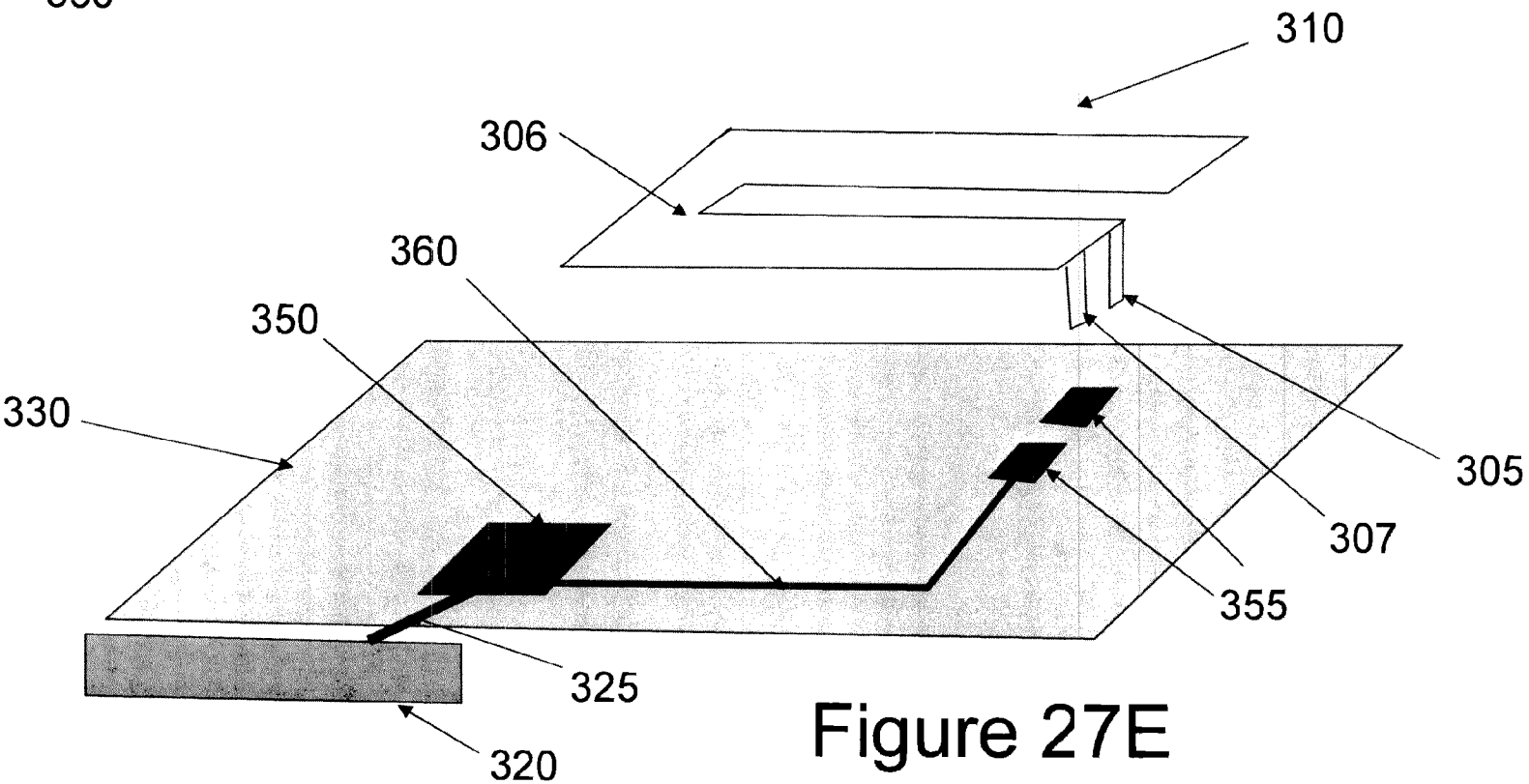
Figure 27F:
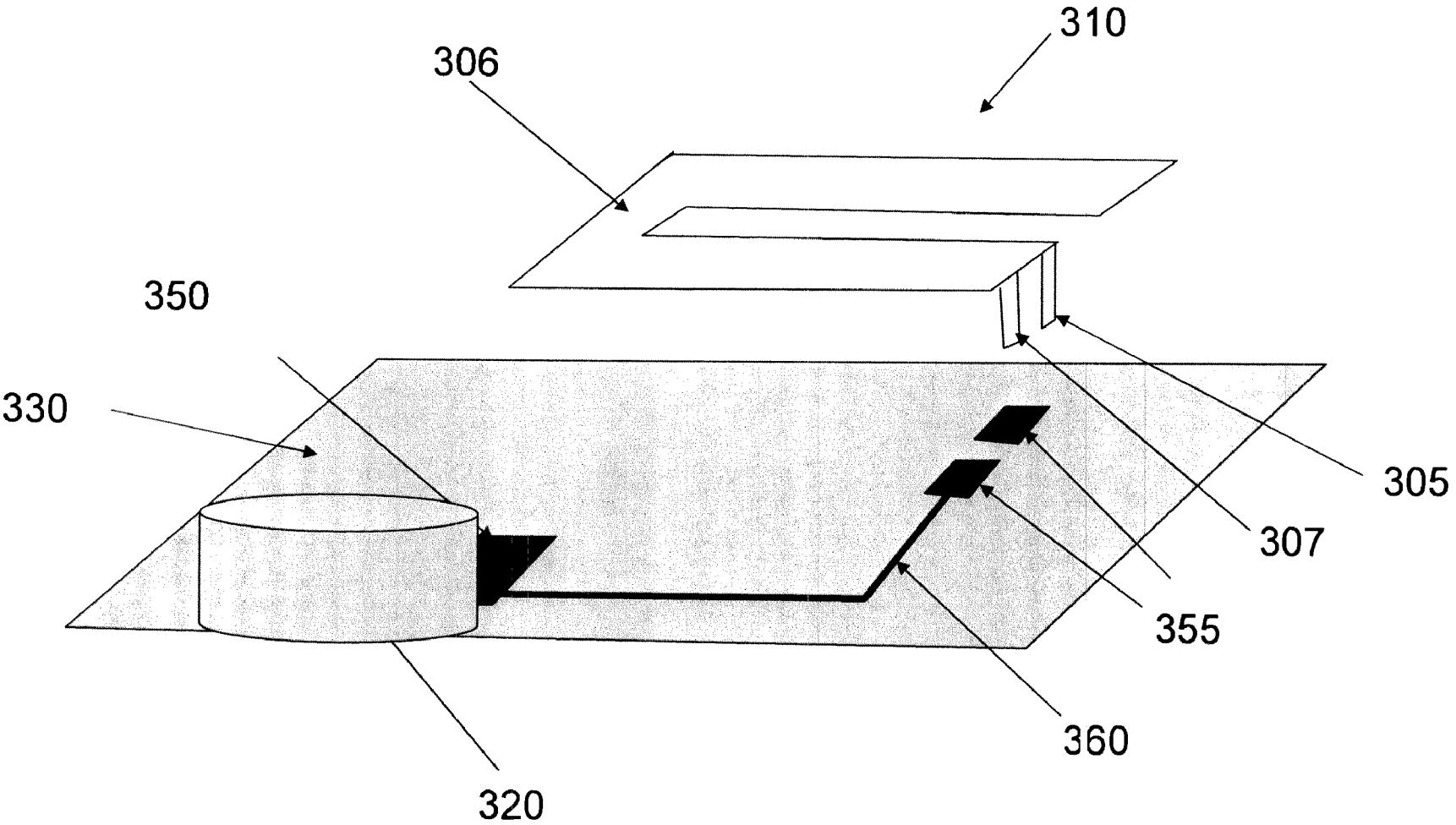
Figure 27G:
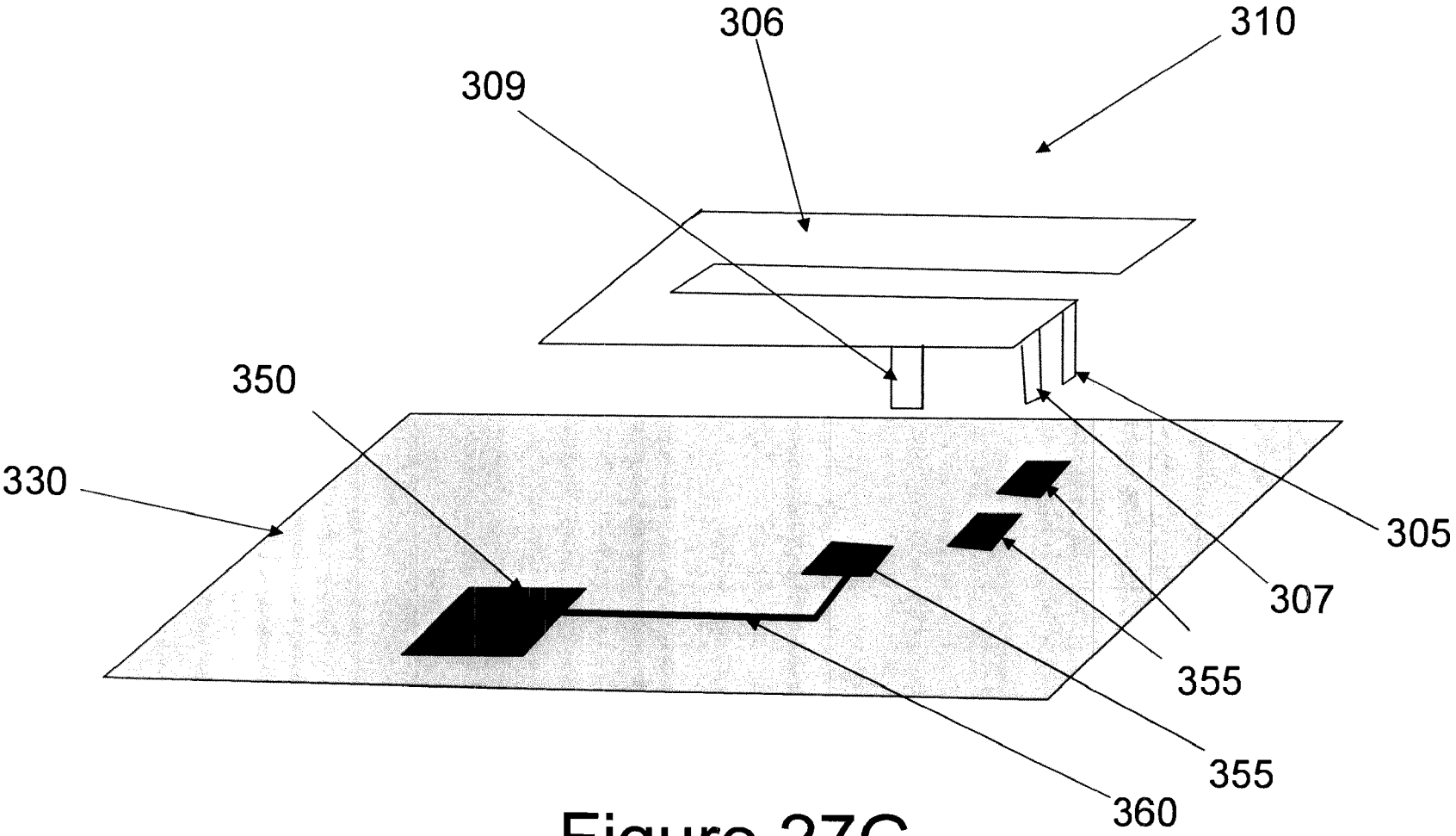
Figure 27H:
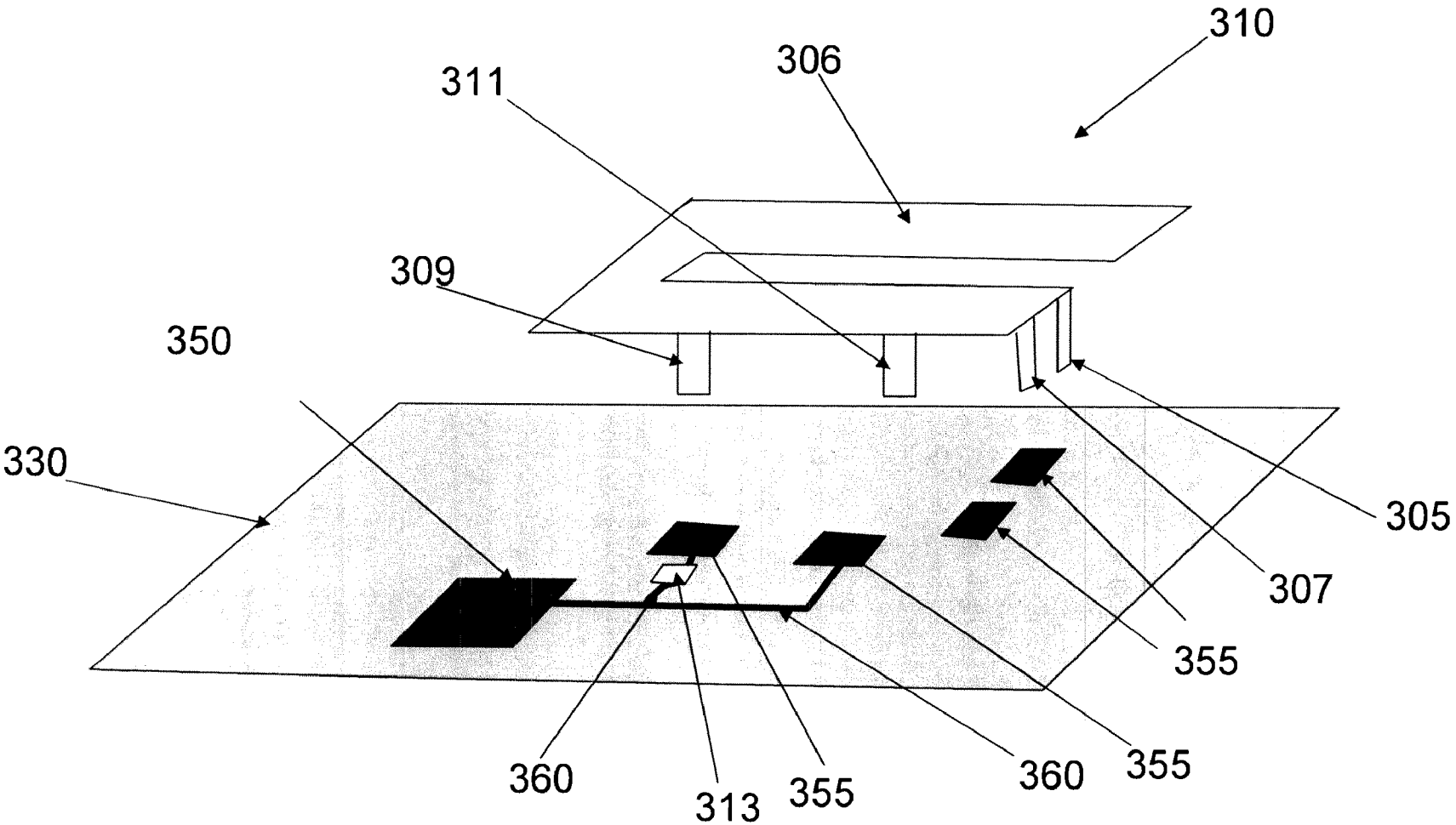

The antenna (310) can include a main radiating portion (306) connected to ground and a feed by ground and feed legs (307 and 305, respectively). Conductive connecting pads (355) can connect the ground leg (307) and feed leg (305) to the printed circuit board (330). In one embodiment, as shown in FIG. 27B, the ground leg (307) can be connected to a conductive pad (350) by a conductive trace (360) between conductive pad (350) and connecting pad (355). In another embodiment, shown in FIG. 27C, the feed leg (305) can be connected to the conductive pad (350) by a conductive trace (360).

As shown in FIGS. 27 D-F, the conductive structure (320) can be connected to the antenna (310) via the conductive pad (350) and conductive trace (360). A connecting leg (325) can be used to connect the conductive structure (320) to the conductive pad (350). As described above, in one embodiment, such as the one shown in FIG. 27E, the conductive structure (320) can comprise a conductive pad positioned in an area on or near the outer surface of the device (300) such that the device user becomes coupled to the conductive structure (320) either directly or capacitively when the user holds the device (300). In another embodiment, as shown in FIG. 27F, the conductive structure (320) can comprise a conductive wheel or other control mechanism for the device. In this embodiment, the device user becomes coupled to the antenna (310) when the user uses the control mechanism.

In other embodiments of the invention, the antenna (310) can include additional connection legs (309, 311). For example, in the embodiment shown in FIG. 27G, a third connection leg (309) can be added for altering the frequency response of the antenna (310). The third connection leg (309) can be connected to the printed circuit board (330) by conductive connecting pad (355) and to connection pad (350) by conductive trace (360). In the embodiment shown in FIG. 27H, a fourth connection leg (311) can be added and a control element (313) can be included to couple the fourth connection leg (311) with connection pad (350). The fourth connection leg (311) can be connected to conductive connecting pad (355) and to connection pad (350) by conductive trace (360) and control element (313).

Figure 28:
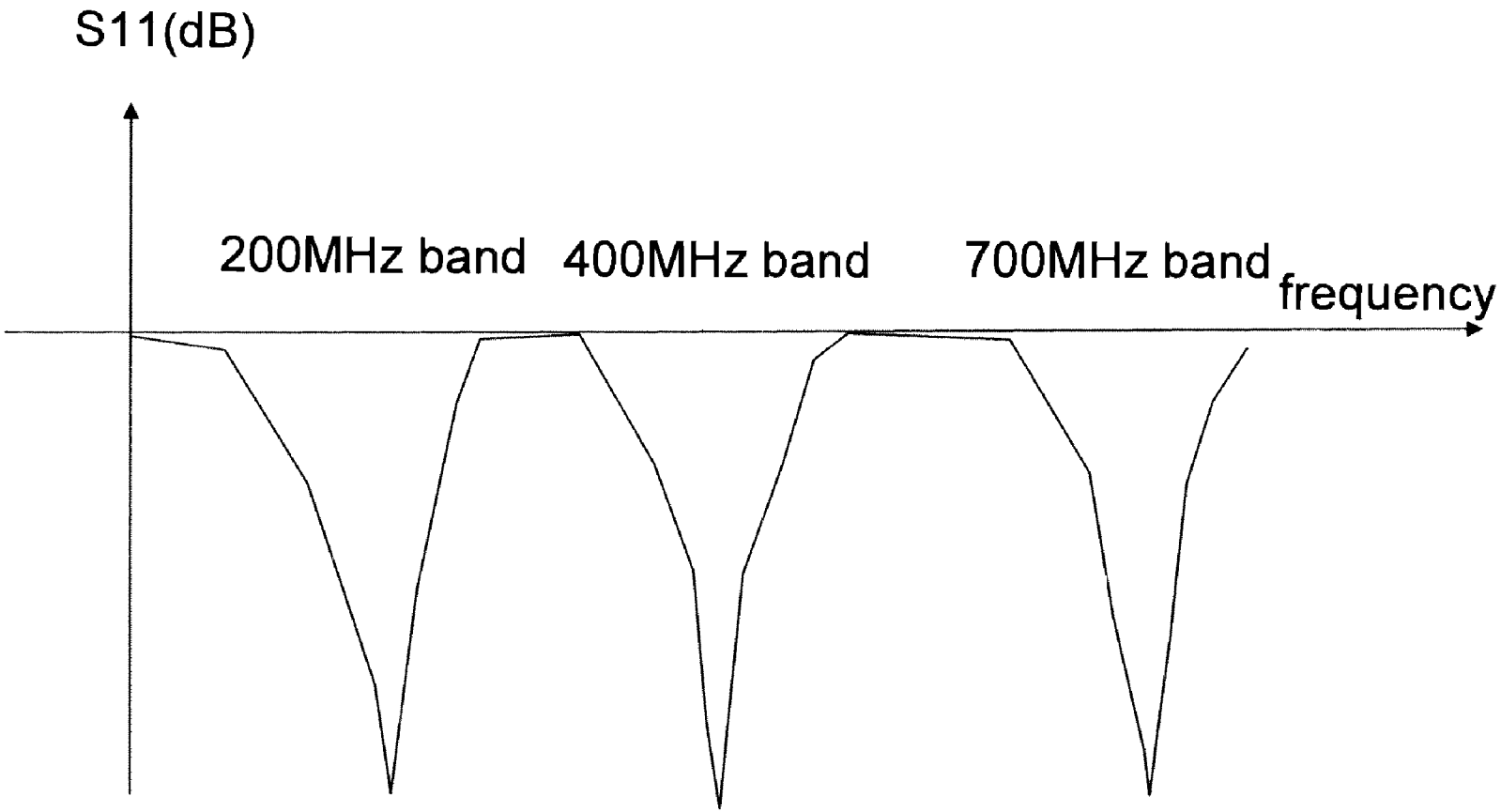
FIG. 28 illustrates a partial mapping of resonant frequencies of one embodiment of an antenna according to the present invention.

In one embodiment, control element (313) can be used to enable control of the antenna resonant frequency. The control element can comprise a device that may exhibit ON-OFF and/or actively controllable capacitive/inductive characteristics. In one embodiment, the control element (313) may comprise transistor devices, FED devices, MEMs devices, or other suitable control element or circuits capable of exhibiting ON-OFF and/or actively controllable capacitive inductive characteristics. The control element may be switched ON or OFF or the capacitance or inductance may be changed to actively control the resonant frequency of the antenna (310). In this manner, it is possible to construct an antenna (310) that can resonate a multiple frequencies, such as 200 MHz, 400 MHz, 700 MHz, 800 MHz, 900 MHz, 1800 MHz, 1900 MHz, etc. As such, the antenna (310) can be configured to support low frequency application, such as broadcast television, as well as higher frequency application such as cellular communications. FIG. 28 illustrates one possible partial mapping of the resonant frequencies of an antenna according to this embodiment of the invention.

Figure 29:
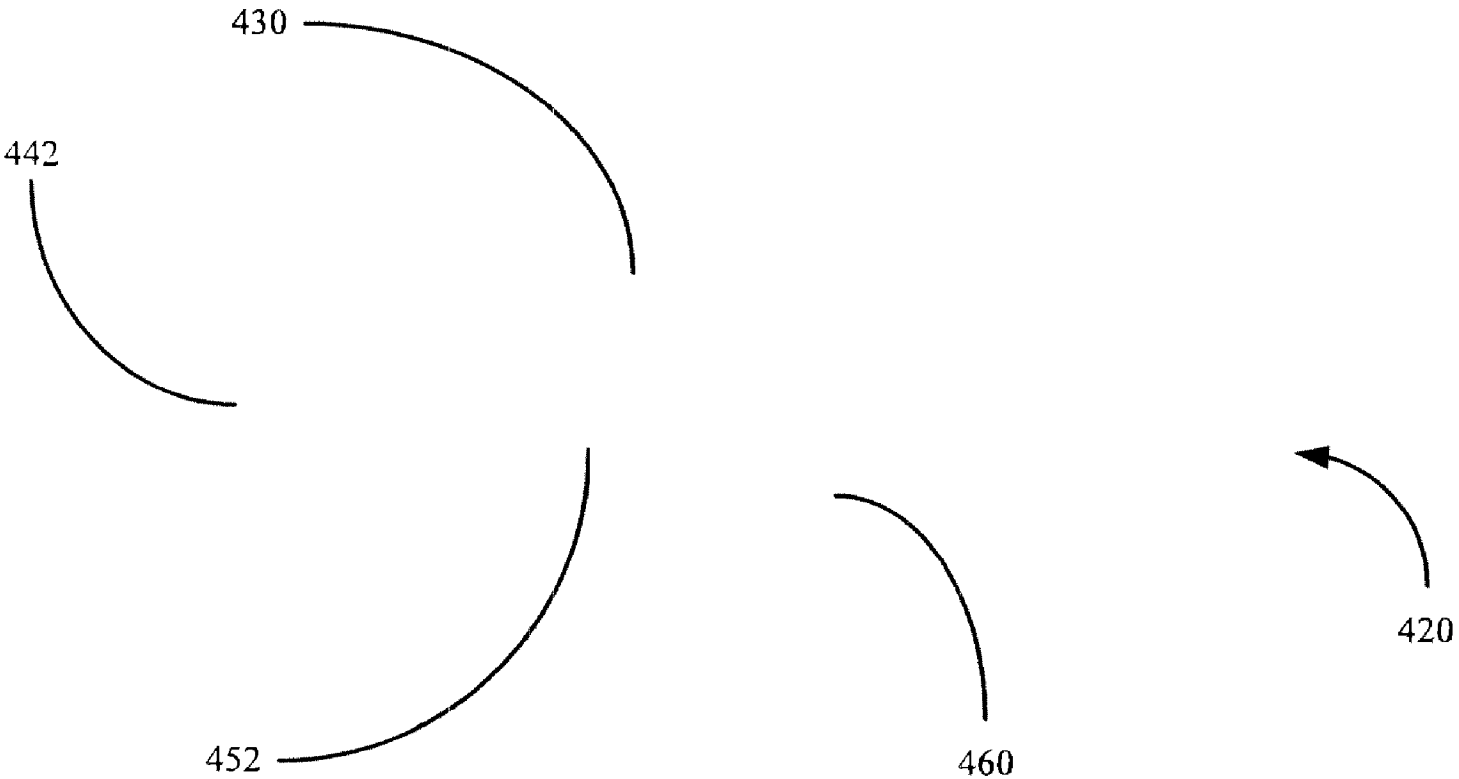
FIG. 29 illustrates another embodiment of the invention incorporating a decorative feature of the mobile device into the antenna.

In another embodiment of the invention, the conductive structure (430) can comprise a decorative feature on the outer surface of the mobile device (420). For example, in the embodiment shown in FIG. 29, the feature is a metallic disc shaped decoration. As in other embodiments, the conductive structure (430) is made of a conductive material and is coupled to the antenna (442) by a conductor (452), which in this case is a conductive screw, and a conductive trace (460). The decorative feature is positioned on the device (420) in an area usually contacted by the user's hand when holding the device (420). In this manner, the user become effectively coupled to the antenna (442) by direct contact with the conductive structure (430) such that the user becomes part of the antenna (442) when the device (420) is in use.

FIGS. 30A-F and 31 illustrate various embodiments of the present invention in which an active device can be utilized to effectively boost efficiency of an existing antenna, such as those described above. The active device can be implemented as a dongle which can be attached to the existing antenna of a mobile device, for example, when it is inconvenient or not possible to utilize a user's body to act as an extension of the existing antenna. Alternatively, the active device can be used in addition to conductive structures, such as those described above.

The existing antenna to be utilized in conjunction with the active element can be an antenna, such as those described above and illustrated in FIGS. 3-19, 21A-C, and 22A-27H. However, the overall size can be increased to boost free space performance. A resonant element is utilized in the existing antenna which is based on Isolated Magnetic Dipole technology. Such antennas are naturally multi-band resonators, where a low band frequency is reduced by adding reactive components to the antenna structure. Such antennas can be utilized within low band frequencies, such as the 200 MHz, 400 MHz, and 700 MHz ranges, i.e., for standard and/or handheld digital video broadcasting and digital media broadcasting.

Figure 30A:
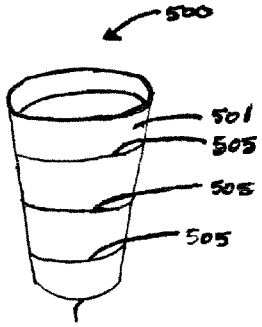
FIGS. 30A-30F illustrate various embodiments of the invention including an active element coupled to an existing antenna.

In one embodiment, a hollow plastic surface or support (501) is provided, around which a coiled, wire antenna (505) is wrapped as shown in FIG. 30A. It should be noted that although the plastic support (501) is illustrated to be substantially conical in shape, other appropriate configurations could be utilized. For example, a substantially cylindrical plastic support (not shown) could be utilized in accordance with the various embodiments of the present invention. Within an area encompassed by the plastic support (501), a magnetic field is created. It should be noted that although plastic is a preferred material to be used, other materials can be utilized in forming the support (501).

Figure 30B:
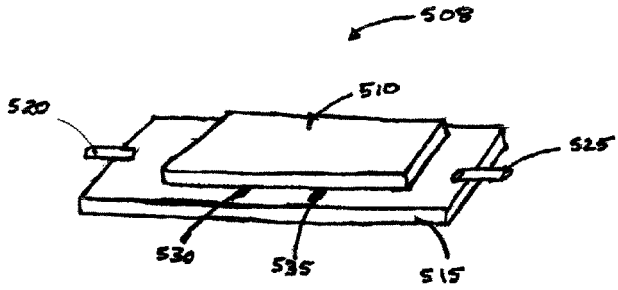

FIG. 30B shows an active element (508) comprised of a low noise amplifier (LNA) unit (510) that is operatively connected to a LNA board (515). The active element (508) is utilized in order to compensate for efficiency losses in free space operation of antennas. It should be noted that although the LNA unit (510) is illustrated as a single module, additional components can be included in the LNA unit (510). The active element (508) is also comprised of a ground pin (530), a Vcc power supply pin (535) used to drive the active element (508), an input pin (520), and an output pin (525). The input pin (520) is operatively connected to an existing antenna, via existing traces or one or more additional traces (not shown). (Please confirm that this is correct. In addition, an outside metallic strip was mentioned in your Recommendations portion of the Low Frequency Antennas presentation, however, nothing about this was mentioned in the handwritten disclosure materials, so I am unsure if your final product would need this strip) The output pin (520) can be operatively connected to the coiled, wire antenna (501) described in more detail below. The ground pin (530) can be operatively connected to an existing ground point or plane, such as grounding plane (6) shown in FIGS. 3-13 or to the printed circuit board (330) shown in FIGS. 27A-H. The Vcc power supply pin (535) can be fed a DC voltage for driving the active element (508), where the DC voltage is routed to the Vcc power supply pin (535) via a wired connection (not shown) from the printed circuit board (330).

Figure 30C:
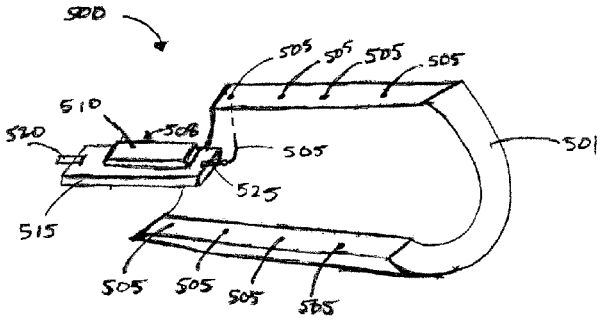

FIG. 30C shows a cutout perspective view of the dongle (500), where the active element (508) is operatively connected to the coiled, wire antenna (505) via the output pin (525). The active element (508) is held substantially in the center of an area encompassed by the plastic support (501) and the coiled, wire antenna (505). It should be noted that in order to maintain the substantially centralized orientation of the active element (508), the active element (508) is physically configured to be relatively light in comparison to the plastic support (501) and the coiled, wire antenna (505). In addition, as shown in FIG. 30C, by inserting the active element (508) substantially halfway into the area defined by the plastic support (501) and the coiled, wire antenna (505), space savings can be realized with still maintaining good efficiency gains and/or electro-characteristics related to antenna excitation. Furthermore, the volume taken up by the active element (508) in the area encompassed by the plastic support (501) and the coiled, wire antenna (505) is kept approximately $1/6^{th}$ of the total volume. Depending on the size of the active element (508), the radius of the plastic support (501) can be determined by substantially adhering to this ratio.

Figure 30D:
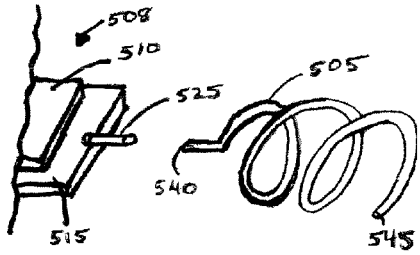

FIG. 30D shows another perspective view of one embodiment of the present invention illustrating one possible method of connecting the coiled, wire antenna (505) to the output pin (525) of the active element (508). As described above, it is important to keep the active element (508) substantially centered within the area encompassed by the plastic support (501) and the coiled, wire antenna (505). Therefore, the output pin (525) is connected to the coiled, wire antenna (505) by a secure contact mechanism. Although FIG. 30D shows that the output pin (525) of the active element (508) is connected to a first end (540) of the coiled, wire antenna (505), it should be understood that a second end (545) can also be extended substantially through the center of the coiled, wire antenna (505). Therefore, the output pin (525) can be connected to the second end (545) of the coiled, wire antenna (505).

Figure 30E:
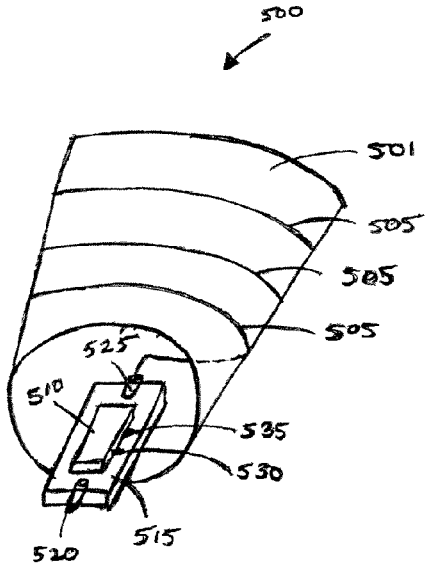

FIG. 30E shows a complete dongle 500 as described above, where the active element (508) is inserted substantially halfway into the area encompassed by the plastic support (501) and the coiled, wire antenna (505). It should be noted that FIG. 30E shows that a last coil of the coiled, wire antenna (505) does not extend to the bottom of the area encompassed by the plastic support (501) and the coiled, wire antenna (505). However, in another embodiment of the present invention, the active element (508) could be oriented so that none of it is within the area encompassed by the plastic support (501) and the coiled, wire antenna (505). In this embodiment, the last coil of the coiled, wire antenna (505) would reach a bottom portion of the plastic support (501) and protrude therefrom.

Figure 30F:
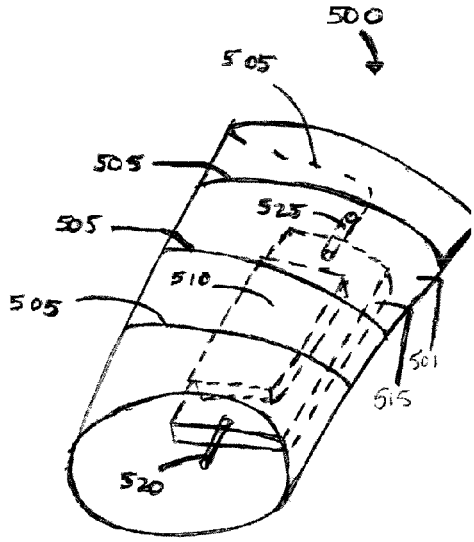

FIG. 30F shows yet another embodiment of the present invention where the active element (508) is inserted in its entirety within the area encompassed by the plastic support (501) and the coiled, wire antenna (505). In this embodiment of the present invention, a flex.(The handwritten disclosure appears to say "flex" but I am unsure what this refers to.) The coiled, wire antenna (505) can be coiled around the flex and the plastic support (501). In addition, the plastic support (501) can include a substantially flat portion for supporting the active element (508).

Figure 31:
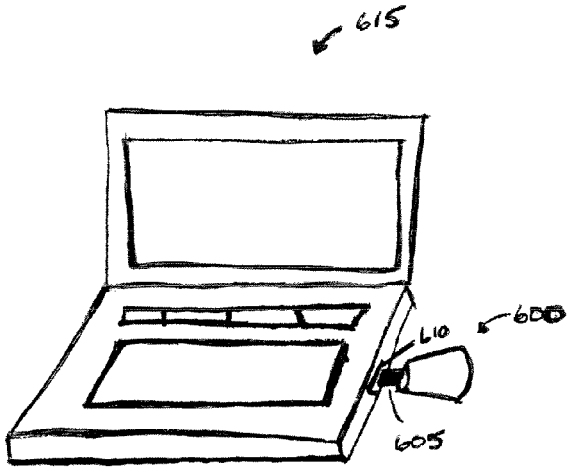
FIG. 31 illustrates another embodiment of the invention for use with universal serial board-equipped devices.

Although the various embodiments of the present invention described herein have to been described in relation to mobile devices, such as mobile telephones, FIG. 31 shows another embodiment of the present invention configured as a USB dongle (600). The USB dongle (600) utilizes substantially the same components or elements as those utilized in the dongle (500) described above. That is, the USB dongle (600) includes substantially the same active element (508), e.g., LNA unit (510), LNA board (515), plastic support (501), coiled wire antenna (505), and output pin (525). However, instead of an input pin that can be connected to an existing mobile device antenna, such as input pin (520), the USB dongle (600) utilizes an input pin (not shown) that is compatible with a USB connector (605). The USB dongle (600) can then be inserted into a USB slot (610) of a laptop computer (615), for example. Therefore, the USB dongle (600) can be utilized as an extension antenna for the laptop computer (615).

FIGS. 32A-37B illustrate various other embodiments of the present invention in which an active device can be utilized to effectively boost efficiency of an existing antenna, such as those described above. The active device can be implemented as one or more antenna coils which can be integrated with the existing antenna of a mobile device, for example, when it is inconvenient or not possible to utilize a user's body to act as an extension of the existing antenna, and/or for example, when low frequency excitation is required.

Figure 32A:
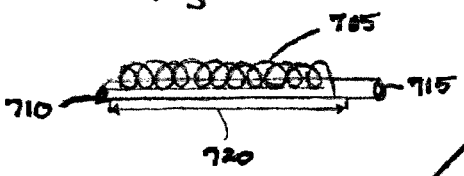
FIGS. 32A and 32B illustrate another embodiment of the invention incorporating an antenna coil applicable to low frequency applications.
Figure 32B:
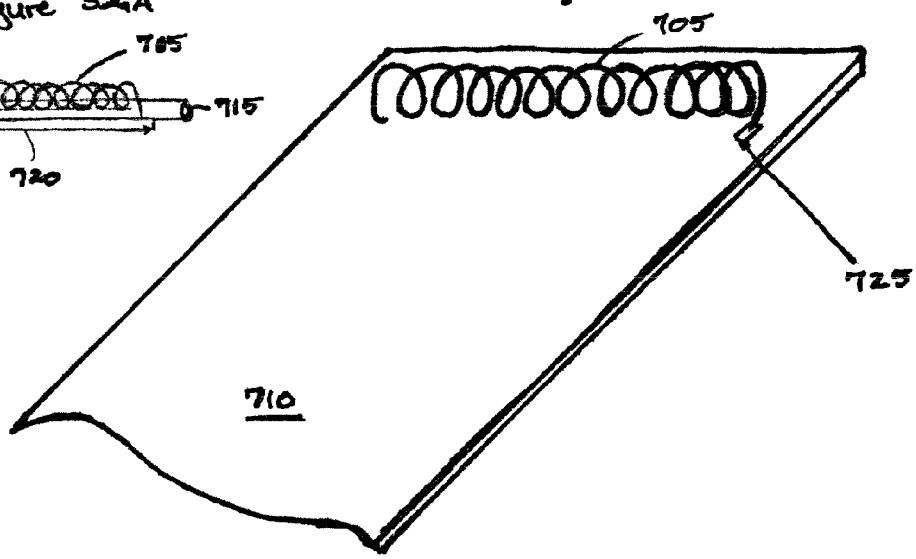

FIGS. 32A and 32B show a side view and a perspective view, respectively, of an antenna coil (705), which can be made of a variety of conducting materials, such as but not limited to, copper. The antenna coil (705) can be configured to have some predetermined length $l_1$ indicated by arrow (715) and a pitch $l_2$ indicated by arrow (720). In addition, the antenna coil (705) is connected to a printed circuit board (PCB) (710), where the PCB (710) can also have integrated thereon, one or more operative or non-operative elements of a device, such as the mobile device (20) described above. Alternatively, the PCB (710) can be utilized solely for integrating the antenna coil (705) with the mobile device (20). It should be noted that the length $l_1$ and the pitch $l_2$ can determine an adjustment frequency. In addition, length $l_1$ and the pitch $l_2$ can provide a mechanism to develop a desired efficiency of the antenna coil (705).

Figure 33A:
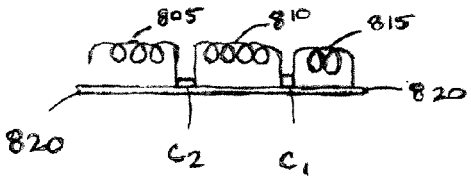
FIGS. 33A and 33B illustrate yet another embodiment of the invention incorporating multiple antenna coils utilized in conjunction with multiple filter components applicable to low frequency applications.
Figure 33B:
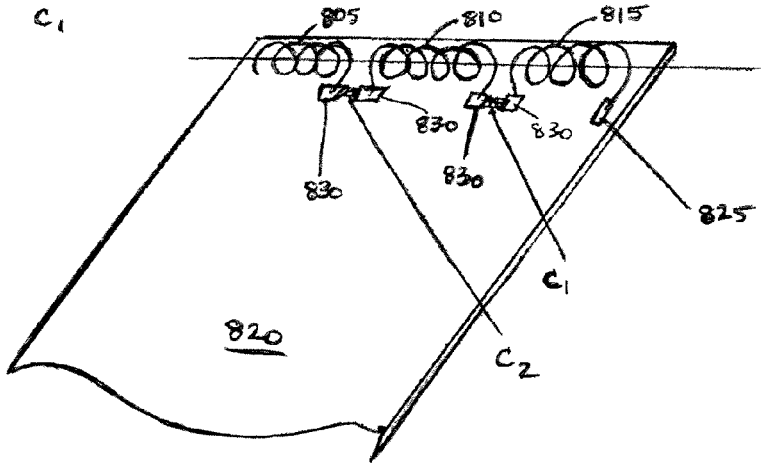

FIGS. 33A and 33B show a side view and a perspective view, respectively, of a plurality of antenna coils (805, 810, 815) integrated unto a PCB (820) via a feed (825). The plurality of antenna coils (805, 810, 815) are utilized to reduce actual coil length, such as the antenna coil (705) described above. Connecting antenna coil (805) to antenna coil (810) and connecting antenna coil (810) to antenna coil (815) are components $C_2$, and $C_1$, respectively, via pads (830). The components C1 and C2 can be inductors or other elements which can add inductive and/or electrical length to the antenna coils (805, 810, 815). Therefore, the main radiative part of this antenna configuration can be considered to be the number of coils put in series with each other.

Figure 33C:
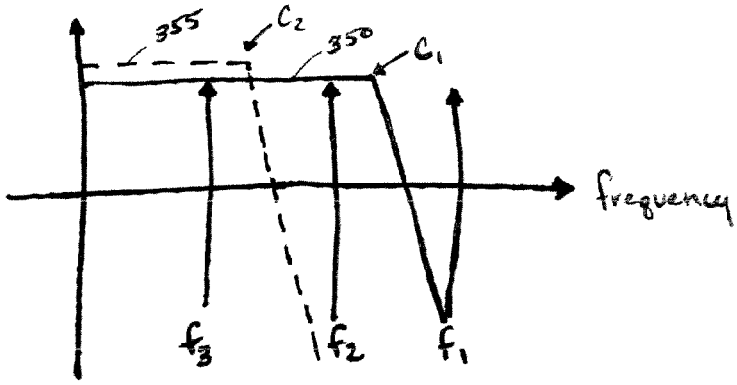
FIG. 33C shows a graphical representation of multiple frequency environments wherein the multiple antenna coils of FIGS. 33A and 33B can be utilized.

In the antenna configuration described with regard to FIGS. 33A and 33B, components C1 and C2 can each act as a filter. Therefore, depending on the action(s) of the components C1 and C2, this antenna configuration can be utilized in a multiple frequency environment, similar to that described above for a magnetic dipole antenna. In particular, the antenna coil (815) can be tuned for a first frequency $f_1$, for example, a high frequency, the antenna coil (810) can be tuned with the antenna coil (815) to read a second frequency $f_2$, and the antenna coil (805) can be tuned with both the antenna coils (810, 815) to reach a third frequency $f_3$. FIG. 33C illustrates a graphical representation of such an operation, where the component $C_1$ can act as a low pass filter tuned to cut off below the frequency $f_2$ indicated by the solid line 850. The component $C_2$ can also act as a filter, which can be tuned to cut off below the frequency $f_2$ indicated by the dotted line 855.

FIGS. 34A and 34B show yet another embodiment of the present invention, where the antenna coil (705) is connected to a trace element (730). The trace element (730) can be connected to the antenna coil (705) and to the PCB (710) by a pad 735. Addition of the trace element (730) to the antenna coil (705) increases the effective electrical length of the antenna coil (705). It should be noted that the trace element (730) can be configured in various shapes, such as that shown in FIG. 34C. It should also be noted that inductive-type components, such as the components $C_1$ and $C_2$ can be integrated therewith.

In accordance with another embodiment of the present invention, FIGS. 35A and 35B illustrate the multiple antenna coils (805, 810, 815) being connected via a plurality of active/switching elements (835). In addition, one of the plurality of active/switching elements (835) can be utilized to connect the trace element (730) the antenna coil (805). Each of the plurality of active/switching elements (835) can comprise a device that may exhibit ON-OFF and/or actively controllable capacitive/inductive characteristics, such as the control element (31) shown in FIGS. 5A and 5B and described previously. It should be noted that each of the active/switching elements (835) may comprise transistor devices, FED devices, MEMs devices, or other suitable control element or circuits capable of exhibiting ON-OFF and/or actively controllable capacitive inductive characteristics. In this particular embodiment, each of the plurality of active/switching elements (835) can be a field effect transistor (FET) acting as a switch. By switching a FET ON or OFF, the antenna coils (805, 810, 815) can be tuned to any desired frequency In addition more or less antenna coils can be utilized in series, and by utilizing multiple FETs, targeting frequencies ranging among other several hundreds of MHZ can be achieved, for example, 200 MHz, 400 MHz, 700 MHz, 800 MHz, 900 MHz, 1800 MHz, 1900 MHz, etc.

Figure 36A:
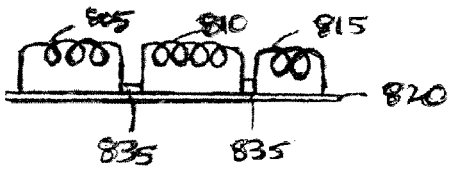
FIGS. 36A-36C illustrate an embodiment of the invention utilizing orthogonal orientation of multiple antenna coils.
Figure 36B:
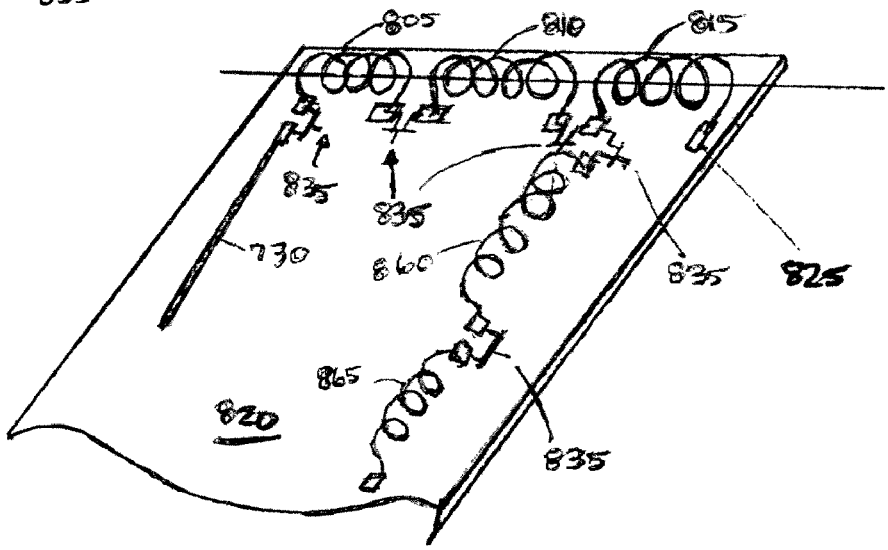
Figure 36C:
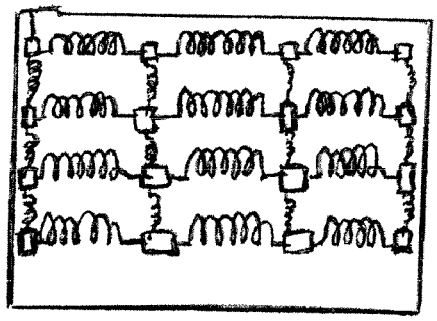

FIGS. 36A-36C show a side view, a perspective view, and a top view, respectively, of an embodiment of the present invention, where multiple antenna coils (805, 810, 815, 860, 865) can be oriented in an orthogonal manner. It should be noted that any number of antenna coils can be utilized. Orthogonal configurations can be suitable for polarization diversity. In addition, orthogonal configurations can provide a desirable level of control with regard to frequency bands. FIG. 36C, in particular illustrates an active control switching a current path.

Figure 37A:
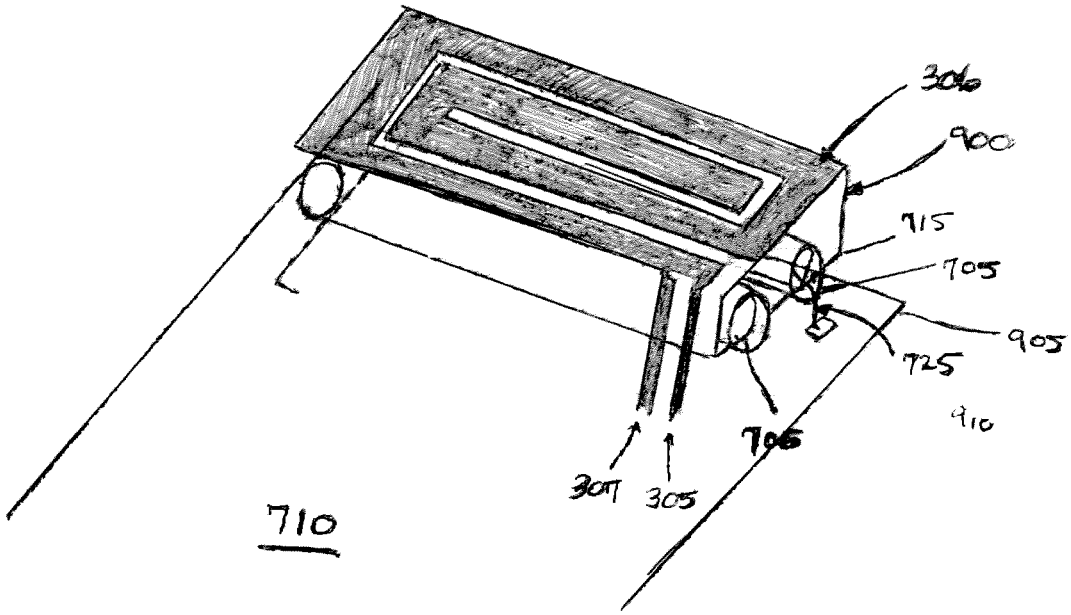
FIGS. 37A and 37B illustrate another embodiment of the invention integrating multiple antenna coils of FIGS. 32A and 32B with an existing antenna element.
Figure 37B:
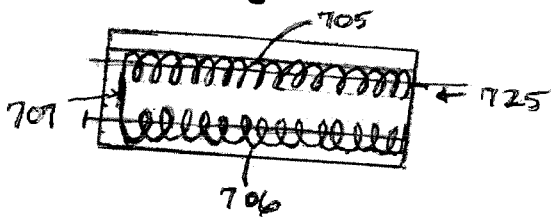

FIGS. 37A and 37B show a perspective view and a cutout top view, respectively, of an embodiment of the present invention, where two antenna coils (705, 706) are embedded in a support (900) upon which an existing antenna (306) is already supported. The existing antenna (306) can be a magnetic dipole antenna, such as that described above, where a ground leg (307) and a feed leg (305) connect to the PCB (710). The support (900) can be configured with two elongated cavities (905, 910) for supporting one of each two antenna coils (705, 706). The support (900) can also be configured to be opened at section (915) to allow introduction of the antenna coils (705, 706) into the support (900). The antenna coil (705) is connected to the PCB (710) via a feed 725. Furthermore, the antenna coil (705) can be connected to the antenna coil (706) via a contact (707). It should be noted that the contact (707) can be a continuation of either of the antenna coils (705, 706). Alternatively, the contact (707) can a spring contact, a contact plate, or any other appropriate type of connector.

Thus, it will be recognized that the preceding description embodies one or more invention that may be practiced in other specific forms without departing from the spirit and essential characteristics of the disclosure and that the invention is not to be limited by the foregoing illustrative details, but rather is to be defined by the appended claims.

What is claimed is:

1. An antenna configured for low frequency application on a mobile device held by a user of the device, the antenna comprising:

an antenna element;

a conductive structure electrically coupled to the antenna element, wherein the conductive structure is positioned such that the user becomes effectively coupled to the antenna element through the conductive structure when the user holds the device; and an active element electrically coupled to the antenna element, wherein the active element effectively boosts free space operation efficiency of the antenna element when the user is not effectively coupled to the antenna element.

2. The antenna of claim 1 wherein the conductive structure is electrically coupled to the antenna element by a conductor.

3. The antenna of claim 2, wherein the conductor is a wire.

4. The antenna of claim 1, wherein the conductive structure comprises a housing of the device.

5. The antenna of claim 1, wherein the conductive structure comprises a piece of conductive material embedded into a housing of the device.

6. The antenna of claim 1, wherein the conductive structure comprises a conductive pad exposed on an outer surface of the device.

7. The antenna of claim 6, wherein the conductive pad comprises a decal including conductive material.

8. The antenna of claim 6, wherein the conductive pad comprises an exposed conductive material embedded into a housing of the device.

9. The antenna of claim 1, wherein the user is coupled to the antenna through direct contact with the conductive structure.

10. The antenna of claim 1, wherein the conductive structure is positioned in an area near enough to a portion of the device onto which the user holds such that the user can be coupled to the antenna through capacitive coupling.

11. The antenna of claim 1, further comprising a control element coupled to the antenna element, the control element being configured for actively reconfiguring the resonant frequency of the antenna to form a multiple band antenna.

12. The antenna of claim 11, wherein the antenna element further comprises a capacitively loaded dipole antenna element.

13. The antenna of claim 1, further comprising a plurality of control elements coupled to the antenna element, the plurality of control elements being configured for actively reconfiguring the resonant frequency of the antenna to form a multiple band antenna.

14. The antenna of claim 13, wherein the antenna element further comprises a capacitively loaded dipole antenna element.

15. The antenna of claim 1, wherein the active element is electrically coupled to the antenna element by at least one conductor via at least a ground pin and a power supply pin.

16. The antenna of claim 15, wherein the at least one conductor is a wire.

17. The antenna of claim 16, wherein the conductor is a universal serial bus connector.

18. The antenna of claim 1, wherein the active element comprises a low noise amplifier unit including a low noise amplifier electrically coupled to a low noise amplifier board.

19. The antenna of claim 1, wherein the active elements is at least partially surrounded by a hollow support structure.

20. The antenna of claim 19, wherein an antenna coil is helically wound around the hollow support structure and wherein the antenna coil is electrically connected to the low noise amplifier unit at one of either a first portion of the antenna coil and a second portion of the antenna coil.

21. The antenna of claim 1, wherein the antenna element comprises a first antenna coil operatively connected to a printed circuit board of the mobile device, the first antenna coil being at least one of frequency and efficiency adjustable via at least one of a length of the first antenna coil and a pitch of the first antenna coil.

22. The antenna of claim 21, wherein an electrical length of the first antenna coil is extended via a trace element operatively connected thereto.

23. The antenna of claim 22, wherein the trace element further comprises at least one inductive component integrated therein.

24. The antenna of claim 21, wherein the antenna element comprises:

a second antenna coil operatively connected to the first antenna coil via a connecting portion, the connecting portion comprises one of a continuation of one of the first and second antenna coils, a spring contact, and a contact plate;

a supporting structure configured for embedding the first and second antenna coils therein; and a second antenna element supported by the support structure, the second antenna element comprising at least one of a ground leg and a feed leg, wherein at least one of the ground leg and the feed leg is operatively connected to the printed circuit board.

25. The antenna of claim 24, wherein the second antenna element comprises a magnetic dipole antenna.

26. The antenna of claim 21, wherein the antenna element further comprises at least a second antenna element operatively connected to the first antenna element via at least one inductive component.

27. The antenna of claim 26, wherein the at least one inductive component acts as a filter for tuning at least one of the first and second antenna elements to a desired frequency.

28. The antenna of claim 21, wherein the antenna element further comprises at least a second antenna element operatively connected to the first antenna element via at least a first switching element, the second antenna element comprising a second antenna coil.

29. The antenna of claim 28, wherein an electrical length of the first and the at least second antenna coils is extended via a trace element operatively connected thereto via a second switching element.

30. The antenna of claim 28, wherein the first and the at least second antenna coils are tuned to a desired frequency by turning the at least first switching element on and off.

31. The antenna of claim 28, further comprising at least a third antenna comprising a third antenna coil operatively connected to one of the first antenna coil and the at least second antenna coil via a second switching element in an orthogonal configuration.

32. A multiband antenna configured for improved low frequency response for use in a mobile device held by a user, the antenna comprising:

a plurality of portions, the plurality of portions coupled to define a capacitively loaded dipole antenna element;

at least one control element connected between two of the plurality of portions such that activation of the control element electrically connects the two portions to effectuate a change in surface geometry of antenna element and deactivation of the control element electrically disconnects the two portions to effectuate a change in surface geometry of the antenna element, the change in geometry causing the antenna element to be actively reconfigured;

a conductive structure electrically coupled to the antenna element, wherein the conductive structure is positioned such that the user becomes effectively coupled to the antenna through the conductive structure when the user holds the device; and an active element electrically coupled to the antenna element, wherein the active element effectively boosts free space operation efficiency of the antenna element when the user is not effectively coupled to the antenna element.

33. The antenna of claim 32, further comprising a ground plane disposed opposition the antenna element and a stub connected to the ground plane creating a gap between the antenna element and the stub for generating an additional resonant frequency for the antenna.

34. The antenna of claim 33, wherein the stub further comprises a first stub part and a second stub part connected by a stub control portion for enabling active reconfiguration of the antenna.

35. The antenna of claim 32, wherein the antenna further comprises a plurality of antenna elements.

36. The antenna of claim 32, wherein the active element is electrically coupled to the antenna element by at least one conductor via at least a ground pin and a power supply pin.

37. The antenna of claim 32, wherein the active element comprises a low noise amplifier at least partially surrounded by a hollow support structure around which an antenna coil is wound, and wherein the antenna coil is electrically coupled to the law noise amplifier.

38. The antenna of claim 32, further comprising at least two antenna coils embedded within a supporting structure, wherein the supporting structure further supports the antenna element.

39. A multiband capacitively loaded dipole antenna with enhanced low frequency characteristics for use in a mobile device held by a user, the antenna comprising:

a conductive top portion including a first portion coupled to a second portion by a connection section;

a ground plane portion disposed opposite to the conductive top portion;

a control portion for enabling active reconfiguration of the antenna, wherein the control portion is connected between two of the first portion, second portion, or connection section such that activation of the control portion electrically connects the two of the first portion, second portion or connection section to effectuate a change in surface geometry of conductive top portion and deactivation of the control portion electrically disconnects the two of the first portion, second portion or connection section to effectuate a change in surface geometry of the conductive top portion, the change in geometry causing the antenna to be actively reconfigured;

a conductive structure electrically coupled to the antenna, wherein the conductive structure is positioned such that the user becomes effectively coupled to the antenna through the conductive structure when the user holds the device; and a low noise amplifier electrically coupled to the antenna, wherein the low noise amplifier effectively boosts free space operation efficiency of the antenna when the user is not effectively coupled to the antenna.

40. The antenna of claim 39, further comprising a plurality of control portions, each of the plurality of control portion connected between two of the first portion, second portion or connection section, such that activation or deactivation of any of the plurality of control portions effectuates a change in surface geometry of the conductive top portion causing the antenna to be actively reconfigured.

41. The antenna of claim 39, wherein the low noise amplifier is at least partially surrounded by a hollow support structure around which an antenna coil is wound, and wherein the antenna coil is electrically coupled to the law noise amplifier.

42. The antenna of claim 39, further comprising at least two antenna coils embedded within a supporting structure, wherein the supporting structure further supports the antenna.

* * * * *